US008376021B2

(12) United States Patent
Hörmann et al.

(10) Patent No.: US 8,376,021 B2
(45) Date of Patent: Feb. 19, 2013

(54) COMPONENT FOR PRODUCING A SECTIONAL DOOR PANEL, SHELL FOR SUCH A COMPONENT, REINFORCEMENT STRUT FOR SUCH A COMPONENT, SECTIONAL DOOR PANEL HAVING SUCH A COMPONENT, AND SECTIONAL DOOR HAVING A CORRESPONDING SECTIONAL DOOR PANEL

(75) Inventors: Thomas J. Hörmann, St. Wendel (DE); Michael Brinkmann, Halle (DE)

(73) Assignee: Hormann KG Brockhagen, Steinhagen (DE)

( * ) Notice: Subject to any disclaimer, the term of this patent is extended or adjusted under 35 U.S.C. 154(b) by 313 days.

(21) Appl. No.: 12/598,194

(22) PCT Filed: May 3, 2007

(86) PCT No.: PCT/EP2007/003918

§ 371 (c)(1),
(2), (4) Date: Mar. 5, 2010

(87) PCT Pub. No.: WO2008/135060

PCT Pub. Date: Nov. 13, 2008

(65) Prior Publication Data

US 2010/0192465 A1 Aug. 5, 2010

(51) Int. Cl.
*E05D 15/00* (2006.01)

(52) U.S. Cl. ..... 160/201; 160/232

(58) Field of Classification Search ..... 160/201, 160/229.1, 232, 199, 207, 236
See application file for complete search history.

(56) References Cited

U.S. PATENT DOCUMENTS

| | | | | |
|---|---|---|---|---|
| 2,863,503 | A * | 12/1958 | Stroup | 160/201 |
| 2,871,932 | A * | 2/1959 | Stroup | 160/40 |
| 3,740,916 | A * | 6/1973 | Kenaga | 52/801.11 |
| 3,967,671 | A * | 7/1976 | Stanley et al. | 160/232 |
| 4,183,393 | A * | 1/1980 | Bailey | 160/232 |
| 4,284,119 | A * | 8/1981 | Martin et al. | 160/232 |
| 4,492,067 | A * | 1/1985 | Martin et al. | 52/784.1 |
| 4,685,266 | A * | 8/1987 | Mullet | 52/309.11 |
| 4,893,666 | A * | 1/1990 | Hormann | 160/229.1 |
| 5,002,114 | A * | 3/1991 | Hormann | 160/229.1 |
| 5,555,923 | A * | 9/1996 | Leist et al. | 160/229.1 |
| 6,047,761 | A * | 4/2000 | Jaehnen et al. | 160/201 |
| 6,554,048 | B1 * | 4/2003 | Jella | 160/229.1 |
| 6,629,387 | B2 * | 10/2003 | Whitley et al. | 52/64 |
| 6,772,818 | B2 * | 8/2004 | Whitley et al. | 160/236 |
| 6,915,573 | B2 * | 7/2005 | Mullet | 29/897.32 |
| 2003/0014940 | A1 * | 1/2003 | Whitley et al. | 52/784.1 |
| 2006/0065374 | A1 | 3/2006 | Colston et al. | |

FOREIGN PATENT DOCUMENTS

| | | |
|---|---|---|
| EP | 0 370 376 A2 | 5/1990 |

* cited by examiner

*Primary Examiner* — David Purol
(74) *Attorney, Agent, or Firm* — Schwabe, Williamson & Wyatt, P.C.

(57) ABSTRACT

A structural element for the fabrication of a panel of a sectional door, which is movable between a closed and an open position along a predetermined pathway. The sectional door possesses a shell, generally of metal, having two mutually parallel sides, bent back on themselves, thus essentially creating structural elements aligned somewhat perpendicularly to the predetermined pathway. When in the closed position, the shell is characterized by forming an outer door surface which is external to the space to be closed, and forming an internal door surface opposed thereto.

40 Claims, 19 Drawing Sheets

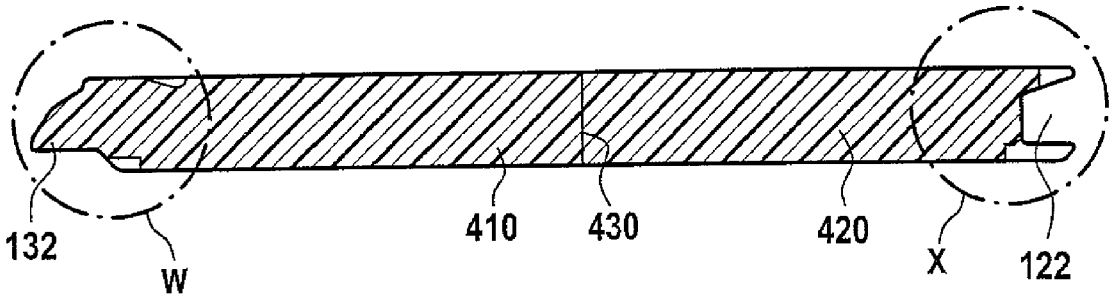
Fig. 6a
Fig. 6b
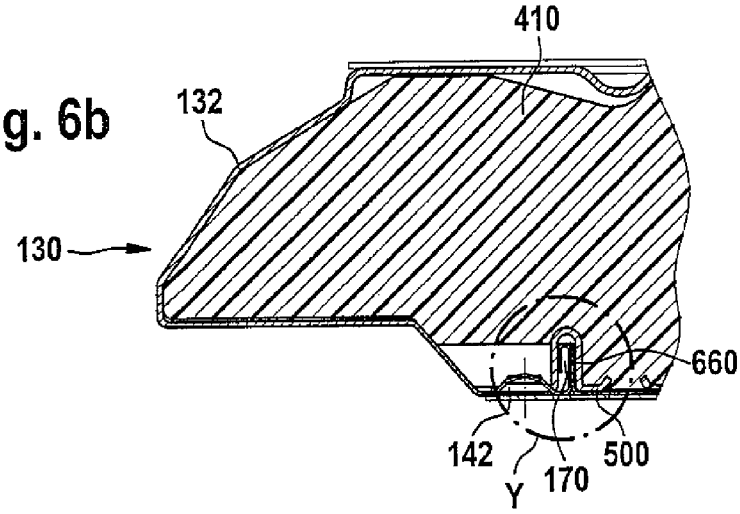
Fig. 6c
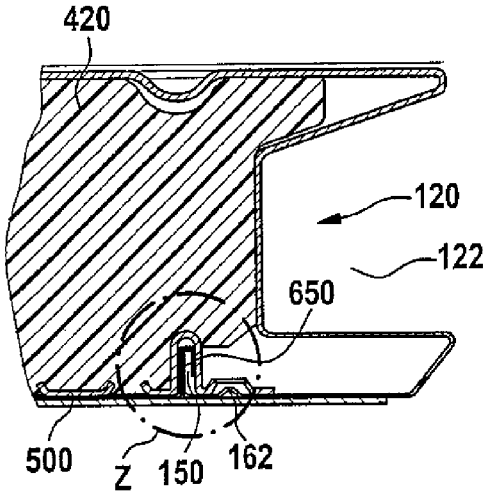

Fig. 9a
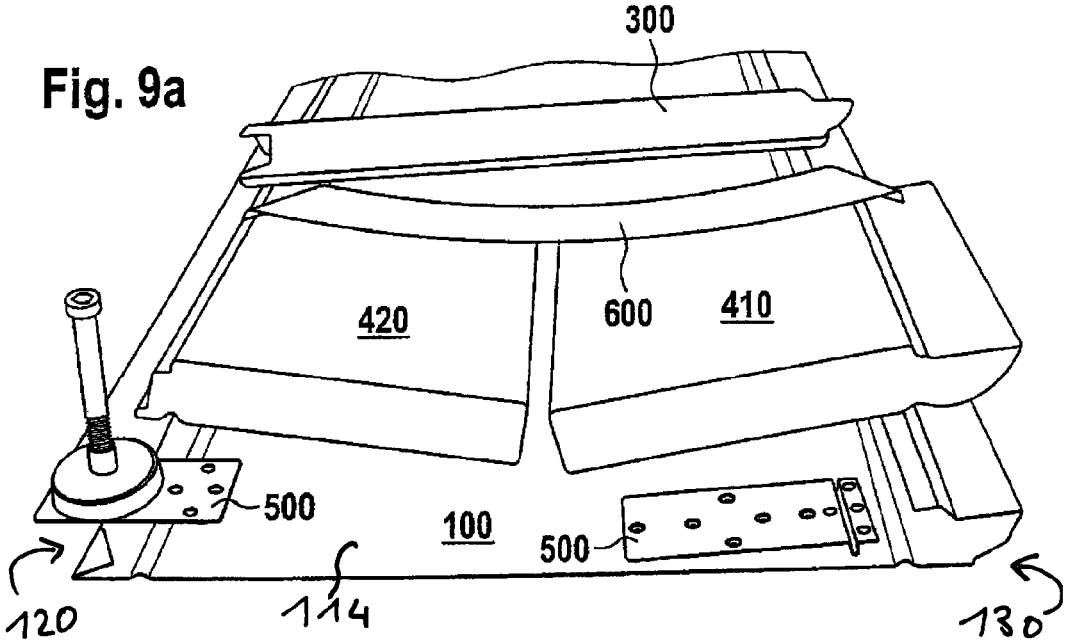
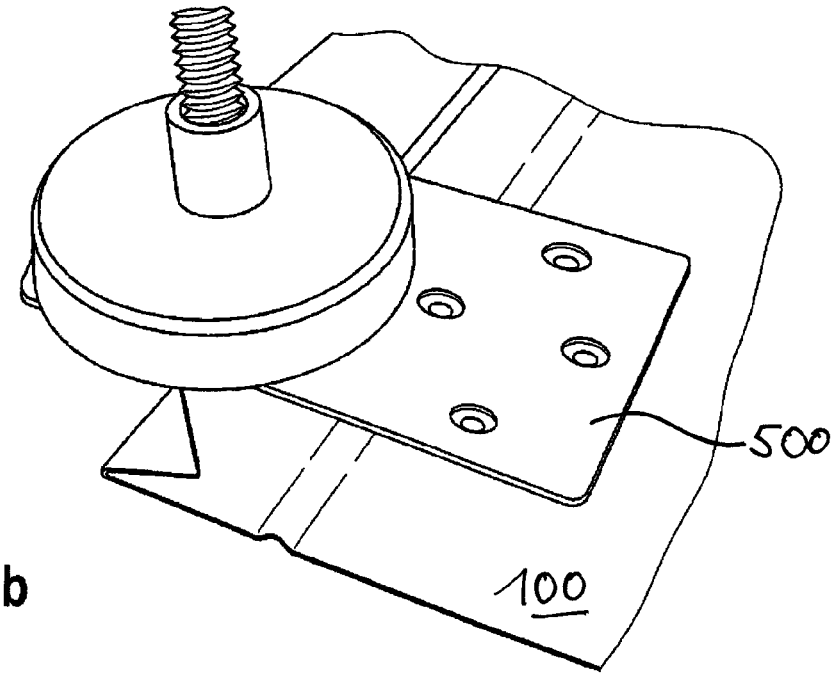
Fig. 9b

COMPONENT FOR PRODUCING A SECTIONAL DOOR PANEL, SHELL FOR SUCH A COMPONENT, REINFORCEMENT STRUT FOR SUCH A COMPONENT, SECTIONAL DOOR PANEL HAVING SUCH A COMPONENT, AND SECTIONAL DOOR HAVING A CORRESPONDING SECTIONAL DOOR PANEL

CROSS REFERENCE TO RELATED APPLICATIONS

The present application is a national phase entry of, and claims priority under 35 U.S.C.§120 to International Application No. PCT/EP2007/003918, filed 3 May 2007, entitled "Component For Producing A Sectional Door Panel, Shell For Such A Component, Reinforcement Strut For Such A Component, Sectional Door Panel Having Such A Component, And Sectional Door Having A Corresponding Sectional Door Panel," the entire content and disclosure of which is hereby incorporated by reference in its entirety.

BACKGROUND

The invention concerns a structural element for making a door leaf of a sectional door, which is movable along a predetermined path between a closed and an open setting, with a shell, especially a metal shell, having two edge portions that run essentially perpendicular to the predetermined path and parallel to each other and that are folded back on themselves to form a predetermined side structure, which has an outer surface that constitutes exterior surface of the door leaf facing away from the interior space to be closed off in the closed setting and an inner surface opposite to the outer surface, wherein at least one side structure of the shell has a fastening area provided for attachment of at least one hinge for connecting structural elements arranged successively in the moving direction of the door leaf.

Sectional doors with a plurality of door leaves having structural elements that can tilt relative to each other with respect to parallel arranged pivot axes are used in the form of garage doors and in the form of industrial doors for closing off passageways in garages and industrial bays. In both cases, the door leaf is usually situated in a vertical plane in the closed setting and in a horizontal plane overhead in the open setting. Guide rails running parallel to each other and situated on either side of the opening being closed are usually provided to guide the movement of the door leaf between the closed setting and the open setting, having a roughly vertical segment that is roughly straight and roughly parallel to the side edge of the door leaf in the closed setting, another usually horizontal segment that is roughly straight and roughly parallel to the side edge of the door leaf in the open setting, and an arc-shaped segment that joins the two straight segments to each other. To enable the movement of the door leaf along the arc-shaped segment, the structural elements forming the door leaf are joined together such that they can tilt relative to each other about pivot axes running perpendicular to the guide rails.

The structural elements forming the door leaf should on the one hand have sufficient stability to ensure a burglar-proof closure of a passageway or a driveway. On the other hand, these structural elements should have the lowest possible weight to facilitate the installation and operation of sectional doors. In traditional sectional door designs, such as are specified in EP-A-304 642 and EP-A-370 376, the structural elements forming the door leaf have a cold-formed metal shell, the thickness of the metal shell being 0.4 mm or less.

In simple sectional doors, a gap allowing a finger to be inserted is formed during a swivel movement of individual door leaf elements, which closes again in the course of the door leaf movement and creates a danger of finger injury. In the case of the sectional door leaves specified in the cited documents, this problem is solved in that the metal shells forming the structural elements have a side structure in the form of a projection, extending in the lengthwise direction of the structural ent and perpendicular to the predetermined path or parallel to the pivot axes along the upper edge in the closed setting, which in the course of a swivel movement can be tilted within a side structure in the form of an indentation, provided at the lower edge of an adjacent panel, avoiding the formation of a gap that can catch the finger.

Although the structural elements are given a stabilization by the side structures for protection against finger injury, the stabilization so achieved in many cases is still not enough to ensure a trouble-free operation. For this reason, in so-called single-shell structural elements, reinforcement struts extending perpendicular to the side structures are placed on the inner surfaces of the shells and joined to the side structure. For this purpose, the side structures usually have a fastening area, also serving for the placement of hinges joining together the successive structural elements. The reinforcement struts are usually riveted to this fastening area, while the reinforcement areas can also be used to stabilize the screws joining the hinge flaps to the fastening area. The fabrication of such single-shell structural elements involves a relatively high expense.

In many cases, sectional doors provide not only a burglar-proof closure of a passageway but also a thermal or acoustic separation of the enclosed spaces from the surroundings. For this purpose, the mentioned documents of the prior an propose structural elements in which a foam core is formed between an outer metal shell, forming the outer boundary surface of the door leaf, and an inner shell of the structural element, forming the inner boundary surface of the door leaf. Such structural elements are made by introducing a self-foaming material, such as polyurethane, into the outer shell and then closing the outer shell by means of the inner shell to limit the foaming process, clamping the inner shell onto the edges of the outer shell that are folded back on themselves. The self-foaming material then fills up the entire inner space of the double-shell door leaf element. Corresponding shell designs are indicated in EP-A-304 642 and EP-A-370 376.

The disclosure contents of these documents are herewith incorporated in this specification by explicit reference as regards the form of structural elements for making of sectional door leaves, especially the form of the side structures of these structural elements providing a protection against finger injury.

The making and installation of the just described double-shell structural elements also involves a high expense. To solve these installation problems, DE 10 2006 012 224 proposes a structural element design in which insulating slabs are placed on an inner surface of the shell, while one edge of the insulating slabs engages at least partly form-fitting with a side structure of the shell.

The disclosure content of DE 10 2006 012 224 is herewith incorporated in this specification by explicit reference as regards the design of the shells of single-shell structural elements for the making of sectional door leaves.

In any case, it has been found that the structural elements specified in the cited document are quickly damaged.

BRIEF DESCRIPTION OF DRAWINGS

In the following description, the invention is described in more detail based on example with reference to the drawing. Shown are.

DETAILED DESCRIPTION OF EMBODIMENTS

Figure 1A:
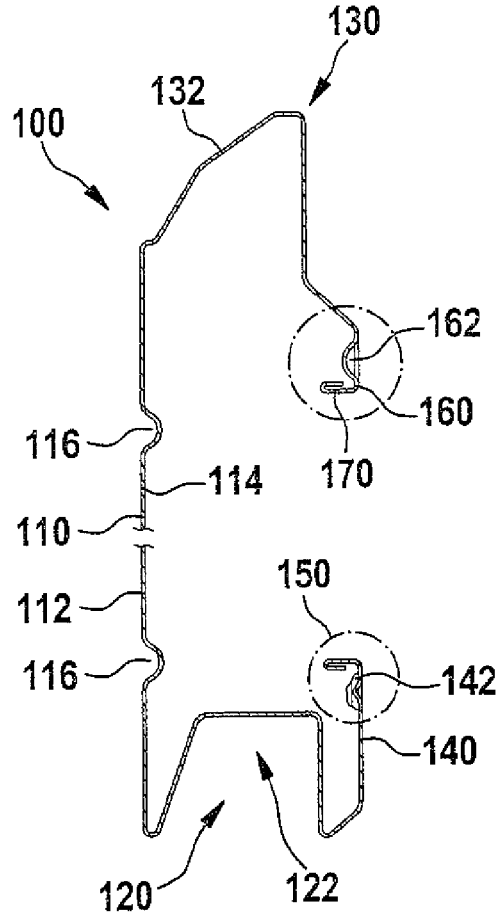
FIG. 1*a*, a sectional representation of a shell according to the invention for a structural element according to the invention, FIG. 1*b*, a view of the inner surface of the shell depicted in FIG. 1*a*, FIG. 1*c*, the detail indicated by X in FIG. 1*a*, FIG. 1*d*, the detail indicated by W in FIG. 1*a*, FIG. 2, a perspective representation of a reinforcement strut according to the invention for the making of a structural element according to the invention by a first embodiment of the invention, FIG. 3, a reinforcement strut according to the invention for the making of a structural element according to the invention by a second embodiment of the invention, FIG. 4, a perspective representation of an end cap according to the invention by a first embodiment of the invention, FIG. 5, a perspective representation of an end cap according to the invention by a second embodiment of the invention, FIG. 6*a*, a sectional representation of a structural element according to the invention in sandwich design, FIG. 6*b*, the detail indicated by W in FIG. 6*a*, FIG. 6*c*, the detail indicated by X in FIG. 6*a*, FIG. 6*d*, the detail indicated by Y in FIG. 6*b*, FIG. 6*e*, the detail indicated by Z in FIG. 6*c*, FIG. 7*a*, a shell according to the invention with an end cap according to the invention in place, FIG. 7*b*, a detail representation of the guide area of the end cap represented in FIG. 7*a*, FIG. 7*c*, a detail representation of the pressing tongue of the end cap represented in FIG. 7*a*, before being bent, FIG. 7*d*, a detail representation of the pressing tongue of the end cap represented in FIG. 7*a*, after being bent, FIG. 7*e*, a profile element group coordinated with the end cap depicted in FIG. 7*a* in the fastening area of the shell, FIG. 7*f*, the end cap of FIG. 7*a* before installation, FIGS. 7*g* and 7*h*, the end cap of FIG. 7*a* during installation, FIG. 8*a*, a perspective representation of a reinforcement strut according to the invention after being mounted on a shell according to the invention, FIG. 8*b*, a detail representation of a first end face edge of the reinforcement strut before installation, FIG. 8*c*, a detail representation of a second end face edge of the reinforcement strut before installation, FIG. 8*d*, a detail representation of the second end face edge in the installed state, FIG. 9*a*, individual parts of a structural element according to the invention in sandwich design, and FIGS. 9*b* to 9*j*, individual installation steps when installing a structural element according to the invention in sandwich design.
Figure 1B:
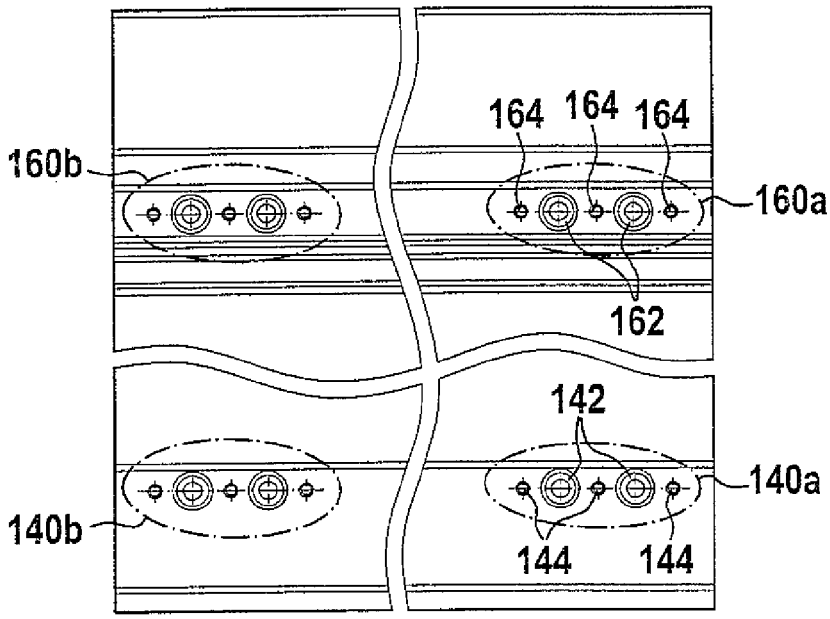
Figure 1C:
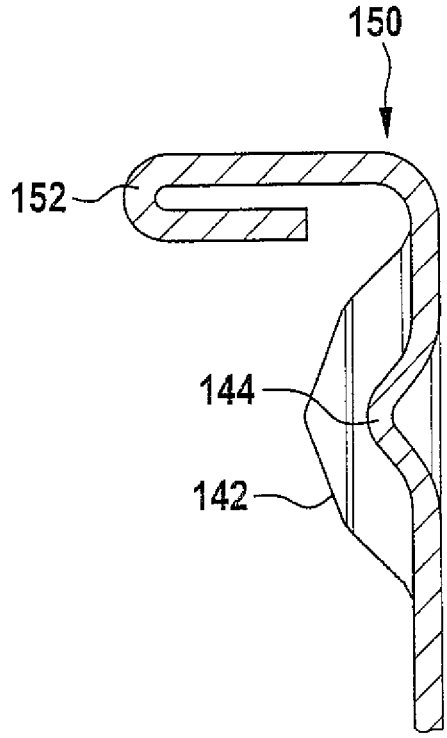
Figure 1D:
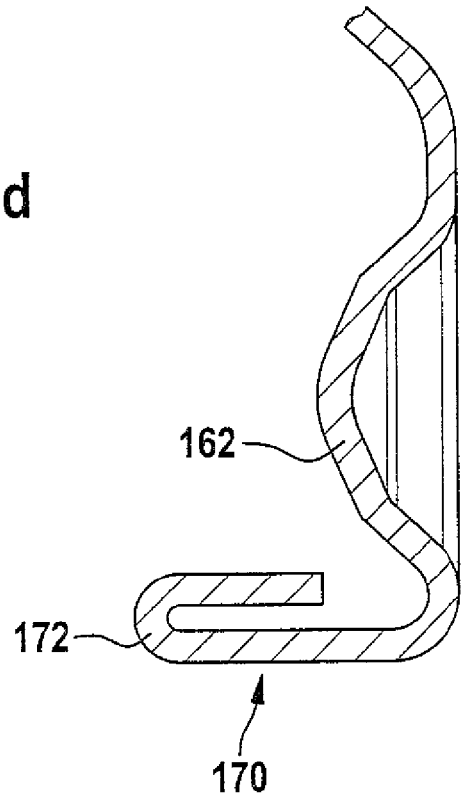

Given the problems in the prior art described in the background section, the invention is to provide structural elements for the making of a sectional door leaf that enable an especially simple fabrication and installation of sectional doors, while optionally a desired insulating action can also be reliably ensured without excessive installation expense.

According to the invention, this problem is solved by a modification of the known structural elements that is essentially characterized in that the fastening area of the shell has at least one positioning aid, preferably one configured as a profiling extending perpendicular to the outer surface, especially a circular dimple, for screws and/or rivets used to fasten the hinge and/or for a reinforcement strut extending roughly perpendicular to the side structures, (preferably adjacent to an inner surface and engaging by an end section with at least one side structure and/or overlapping the side structure.

This invention relies on the experience that the fabrication of single-shell structural elements can be significantly simplified by doing away with the fixation of the reinforcement struts to the fastening areas of the shell by means of rivets if the preliminary installation of the reinforcement struts is facilitated without additional fastening by means of suitable positioning aids at the fastening area and an optionally form-fitting interacting engagement of the reinforcement struts by the positioning aids, especially the positioning of the reinforcement struts at a predetermined place in the lengthwise direction of the side structure. A final fixation of the reinforcement struts to the shell can then be created by means of screws also serving to fasten the hinges joining together the successive structural elements, if these screws pass through the fastening area and the reinforcement struts. At the same time, the positioning aid can be used to determine the position of the screw connections so that the screws pass through the fastening area of the shell and the preassembled reinforcement strut.

The fabrication of double-shell panels can also be facilitated by means of a positioning aid according to the invention, because this can facilitate the positioning of the hinges joining together the successive structural elements. For both single-shell and double-shell structural elements, the positioning aid can be fabricated in the course of the profiling of the preferably cold-formed metal shell. An additional work step to form holes in the fastening areas of the shell to determine the position of the screws is not necessary.

To guarantee an especially true-to-position preliminary assembly and/or in view of the fact that the hinge flaps are usually placed on the fastening areas of the shell with two, three or more screws, it has proven to be especially expedient for the positioning aid of the structural elements according to the invention to have at least one group of two, three or more profile elements situated alongside each other in the lengthwise dimension of the side structure, each of which can be formed as a dimple, while the profile elements are coordinated with a group, a hinge and/or a reinforcement strut.

The profile elements of one group of the positioning aid can be used both for positioning of the screws used to fasten the hinge and for determining the position of the reinforcement struts during the preliminary assembly. Different profile shapes can also be used for the different tasks of the profile elements. But it has proven to be expedient for at least two profile elements of a group, such as the profile elements used for the positioning of the reinforcement strut and/or the profile elements used for the determination of the position of the screws to have roughly the same configuration in a cross sectional plane perpendicular to the lengthwise direction of the side structure. They can then be recognized as belonging together. In any case, it is further expedient for the profile elements assigned to different tasks to also be distinguishable from each other by their shape. For this reason, it has proven to be expedient for at least two profile elements of a group to have different configuration in a cross sectional plane perpendicular to the lengthwise direction of the side structure, especially to have different profile depths and/or diameters. The profile elements used for the preliminary assembly of the reinforcement struts can have a greater depth and/or a greater diameter than the profile elements used to determine the position of the fastening screws. The profiling also causes a (slight) material weakening. Therefore, to ensure a satisfactory fastening of the hinges, it is advisable for the profile elements used to determine the position of the fastening screws to have only a slight profile depth in order to guarantee a firm seating of the screws in the profiling.

In view of the only slight width of the hinge flaps in the lengthwise direction of the side structures or the reinforcement struts in the lengthwise direction of the side structures, the profile elements of one group are arranged in the lengthwise direction of the side structure preferably within a length range of 80 mm or less, especially 60 mm or less, especially preferably around 40 mm. Furthermore, in view of the fact that two, three or more hinges or reinforcement struts are arranged alongside each other in the lengthwise direction of the side structures, the invention outfits at least one side structure with two, three or more groups of profile elements situated alongside each other in the lengthwise direction, while individual profile elements of groups situated alongside each other in view of the usual spacing between individual hinges or reinforcement struts are situated at a distance of 300 mm or more, especially 400 mm or more, especially preferably 600 mm or more from each other.

The installation of structural elements or sectional door leaves according to the invention can be further simplified if the profile elements of identical cross sectional form within different groups have the same spacings in the lengthwise direction of the side structure from each other, because this enables the use of the same reinforcement struts and/or hinges at different places of the structural element.

A stabilization of the fastening area and the entire side structure of the shell can be achieved if the fastening area extending parallel to the inner surface passes at the edge into a stabilization area, roughly perpendicular to the outer surface, extending parallel to the side structure and starting from the fastening area moving toward the inner surface, being preferably folded back on itself relative to a bending line running parallel to the lengthwise direction of the side structure, while the edge of the stabilization profile or the bending line turned toward the inner surface runs at a distance, especially a distance of 15 mm or more, preferably 25 mm or more, from the inner surface. The edge of an insulation element and/or a reinforcement strut can then be introduced into a side structure of the shell between the stabilization area and the inner surface of the shell.

To ensure the desired positioning of the reinforcement strut relative to the shell, it has furthermore proven to be beneficial for at least one reinforcement strut to have an engaging structure preferably adjacent to the boundary surface of the fastening area facing, away from the inner surface of the shell and configured complementary to at least one profile element of the positioning aid. The engaging structure can have at least one recess at least partly occupied by a profile element in the installed state and/or a profile element at least partly contained in at least one profile element of the fastening area, especially in the form of a dimple preferably with a recess passing through it. Advisedly, a recess in the reinforcement strut is matched up with the profile elements of the shell for the positioning of the fastening screws, while a dimple with a recess passing through its apex is matched up with the profile elements of the shell intended for the positioning of the reinforcement strut.

The reinforcing action can be intensified if at least one reinforcement strut has at least one fastening area adjoining the inner or outer surface of the shell and preferably joined by a material connection to the inner and outer surface, especially by gluing. Furthermore, the gluing can also achieve an additional soundproofing, even if the thickness of the glue layer between fastening area on the one hand and inner or outer surface of the shell, on the other hand, is only 0.5 mm or less.

An especially good reinforcing action can be achieved if at least one reinforcement strut is basically U-shaped, with two outer legs and a connection leg joining the outer legs to each other, while the engaging structure is advisedly made on at least one edge of the connection leg overlapping and/or reaching under the fastening area of the shell and at least one fastening surface on an edge area of an outer leg facing away from the connection leg and extending roughly parallel to it. A further improved stabilization action can be achieved with a compact design of the reinforcement strut if a fastening area is formed on each outer leg, while the fastening surfaces preferably protrude into the inner space of the reinforcement strut formed between the outer legs, especially if they protrude into this inner space at an angle and can run in the same plane.

Structural elements with reinforcement struts inserted between the side structures of the shell can also be used in connection with insulation elements adjacent to the inner surface of the shell. In this case, an additional fixation of the insulation element on the shell can be accomplished by means of the reinforcement struts fastened to the shell if at least one reinforcement strut has a fixation area formed preferably between two parallel running slotlike recesses in at least one outer leg for the fixation of an insulation element adjacent to the inner surface. The fixation area, which in the preassembled state usually runs coplanar to the rest of the outer leg, can be forced out from the outer surface and forced into the edge of the insulation element for the fixation of the insulation element lying with its main surface adjacent to the inner surface of the shell and the insulation element adjacent by one edge to the outer leg of the reinforcement strut.

For a form-fitting fastening of the reinforcement strut to the shell, at least one end face of a reinforcement strut can have a clamping area, whose distance from the edge of the connection leg overlapping the fastening area of the shell in a direction running perpendicular to the connection leg roughly corresponds to the width of the stabilization area of the shell in this direction, so that the stabilization area in the assembled state is clamped between the clamping area of the reinforcement strut and the edge of the connection leg overlapping the fastening area of the shell. The clamped fastening of the reinforcement strut can be made more easy to install if at least one clamping area of the reinforcement strut is coordinated with a guide area, along which the stabilization area of the shell is guided along the inner surface of the shell when installing the reinforcement strut before it locks between the connection leg and the clamping area.

The reinforcement struts can be arranged between the edges of the shell running perpendicular to the side structures. In this case, one end face of the reinforcement struts is introduced into a side structure of the shell so that a connection leg of the reinforcement strut lies against the corresponding fastening area of the side structure. The reinforcement strut is then swung about a swivel axis running parallel to the side structure in the direction of the inner surface of the shell. The installation can be simplified if the guide area along which the stabilization area of the shell is guided during the mounting of the reinforcement strut on the inner surface has a ramp area rising up from an edge region lying between the edge of the outer leg facing away from the connection leg and the clamping area in the direction of the clamping area. The reinforcement area of the shell can slide along this ramp area in the course of the swivel movement of the reinforcement strut until the edge of the reinforcement area facing away from the fastening area of the shell or the corresponding bending line of the reinforcement area comes to lie against the clamping area or be locked there, while at the same time the fastening surfaces of the reinforcement strut come to lie against the inner surface of the shell.

The invention also considers fashioning the reinforcement struts in the form of end caps, which are placed on one edge of the shell running perpendicular to the side structures, wherein one outer fastening surface of the end cap comes to lie against an outer surface of the shell, while an inner fastening surface of the end cap comes to lie against an inner surface of the shell. The inner fastening surface is moved at a distance across the inner surface of the shell and only when the outer leg of the reinforcement strut having the outer fastening surface comes to bear against the end face of the shell is it swung about a pivot axis running parallel to the corresponding edge of the shell in the direction of the inner surface. In this case, it has proven to be beneficial for the guide area to have at least one tongue bent outward from one outer leg of the reinforcement strut and bent back on itself in the direction of the outer leg, while the apex of the tongue comes to lie against the stabilization area of the shell.

As already mentioned, in a structural element according to the invention at least one reinforcement strut is configured as an end cap spanning an edge at the end face and extending roughly perpendicular to the side structures. At least one end cap here has an outer fastening surface adjacent to the outer surface and an inner fastening surface at a distance from the latter in the lengthwise direction of the side structure and adjacent to the inner surface of the shell.

In traditional structural elements for the fabrication of sectional door leaves, a noise production in the area of the end caps is prevented in that the shell forming the outer surface is forced by means of an insulator element against an outer fastening surface of the end cap. This involves additional material and labor expense. In the structural elements of the invention, it has proven to be beneficial for the outer leg having the outer fastening surface to have a pressing tongue bounded by a preferably V or U-shaped slot and able to be bent into the interior of the end cap for pressing the outer surface against the outer fastening surface. In this case, manufacturing inaccuracies and variations in material thickness can be balanced out if the connection line between the ends of the U-shaped slot that determines the bending line of the pressing tongue makes an acute angle with a normal to the surface on the outer fastening surface or the outer surface, while one of the outer legs of the U-shaped slot facing the outer fastening surface runs roughly parallel to the outer fastening surface.

As already explained above in connection with design of structural elements of the prior art, it has proven to be beneficial, for insulating purposes, that the structural element also have an insulator arrangement adjacent to the inner surface of the shell and preferably engaging at least partly with at least one side structure of the shell, especially one made of Styrofoam and/or PU foam. Especially in such cases where the shell has a stabilization area adjoining the fastening area, as described above, it has proven to be beneficial, for installation purposes, that the insulator arrangement have at least two insulating elements separated from each other along a plane of separation running parallel to the side structures, wherein at least one insulator element has an edge region reaching under a stabilization area and accommodated at least partly in a side structure. To avoid damage to the insulator arrangement, it has proven to be expedient to provide a cover device covering a boundary surface of the insulator arrangement facing away from the inner surface of the shell.

In traditional double-shell structural elements of the kind described above, the cover device is clipped onto the fastening area of the shell such that the fastening area is overlapped. In structural elements of the invention, on the contrary, it has proven to be expedient for the cover device to have a cover area running roughly parallel to the inner surface of the outer shell and at least one edge area running parallel to the stabilization area of the shell and adjacent to it, because in this way one can avoid an overlapping between cover device and fastening area that would hide the positioning aid, while at the same time a precise determination of the position of the cover device is made possible by interaction of the stabilization area and the adjacent edge areas of the cover device if the distance between the edge areas of the cover device in a direction running perpendicular thereto corresponds roughly to the distance between the stabilization areas of the shell in this direction.

In any case, an additional material thickening by edge areas of the shell or the cover device folded back on each other with avoidance of additional reinforcement struts cannot be achieved in this way. For this reason, a structural element of the invention advisedly has a reinforcement arrangement adjacent to the boundary surface of the fastening area facing the inner surface of the shell and preferably held by a positioning aid in a predetermined position relative to the fastening area. The reinforcement arrangement can have two, three or more reinforcement elements arranged alongside each other with a spacing in the lengthwise direction of the side structure, adapted to the number of hinges used for the connecting of successive structural elements, while at least one reinforcement element has two, three or more recesses designed to receive screws serving for the fastening of the hinge flaps, of which two, three or more recesses preferably receive, at least partly, at least one profile element of the positioning arrangement.

To improve the position determination between shell, on the one hand, and cover device, on the other, it has proven to be expedient for the reinforcement arrangement or at least one reinforcement element to have a groove accommodating a stabilization area of the outer shell and an edge area of the cover device, where the walls of the groove advisedly run parallel to the stabilization area or edge area of the cover device and the depth of the groove roughly corresponds to the width of the stabilization area or the edge area of the cover device or is greater than it.

In structural elements according to the invention the ratio of the length of the shell in the direction of the side structures to the height of the shell in the direction of movement of the door leaf, perpendicular to the side structures, is advisedly 15 or less, preferably 10 or less, in order to have sufficient stability.

As can be appreciated from the preceding explanation, a shell according to the invention for the fabrication of a structural element according to the invention is characterized basically in that a fastening area serving for the fastening of hinge flaps has at least one positioning aid designed preferably as a profiling extending perpendicular to the outer surface, especially a circular dimple, for screws and/or rivets serving to fasten the hinge and/or for reinforcement struts extending roughly perpendicular to the side structures and/or overlapping the side structure.

A reinforcement strut according to the invention for making a structural element according to the invention is basically characterized by an engaging structure designed complementary to the positioning aid.

A sectional door according to the invention, made from structural elements according to the invention, comprises a plurality of structural elements arranged consecutively in the direction of movement of the door leaf, wherein a sectional door having such a sectional door leaf also additionally has a guide rail arrangement with two guide rails, each of which comprises a first straight segment to accommodate the sectional door leaf in the closed setting, a second straight segment to accommodate the sectional door leaf in the open setting, and a section having an arc-shaped segment that joins the straight segments to each other.

The shell 100 shown in FIG. 1, made from a cold-formed metal sheet, comprises a shell bottom 110 with an outer surface 112 forming an outer boundary surface of the door leaf and an inner surface 114 opposite the outer surface 112, as well as side structures 120 and 130 extending in the lengthwise direction of the shell 100 and being folded hack upon themselves. In the side structure 120, an indentation 122 is formed extending in the lengthwise direction of the shell 100, adjoined by a fastening area 140 and a stabilization area 150. On the side structure 130 is formed a projection 132 roughly complementary to the indentation 122, which extends in the lengthwise direction of the shell 100 and is adjoined by a fastening area 160 and a stabilization area 170. In regard to the form and function of the indentation 122 and the projection 132, reference is made to the corresponding remarks in EP-B-370 376 and EP-B-370 324.

The fastening areas 140 and 160 extend at the same distance roughly parallel to the inner surface 114 of the shell bottom 110, while the stabilization areas 150 and 170 extend roughly perpendicular thereto, starting from the fastening areas 140 and 160 and moving toward the shell bottom 110. As is clearly shown in FIG. 1*c* and 1*d*, the stabilization areas 150 and 170 are folded back on themselves along a bending line 152 or 172, running parallel to the lengthwise direction of the shell 100.

The fastening areas 140 and 160 are provided with positioning aids 142, 144 in the form of dimples extending from the fastening areas 140 and 160 to the inner surface 114 of the shell bottom 110. As is especially clearly shown in FIG. 1*b*, the positioning aids 142, 144, 162 and 164 are arranged in the form of several groups of profile elements, the groups 140*a* and 140*b* or 160*a* and 160*b* being situated alongside each other in the lengthwise direction of the side structures 120 or 130. Each group of profile elements 140*a*, 140*b*, 160*a*, 160*b* comprises two profile elements 162 with a large profile depth and three profile elements 164 with a smaller profile depth. The profile elements 142 and 162 are somewhat circular in the view of FIG. 1*b* and have a polygonal shape in a plane of intersection that is perpendicular to this, the profile depth being around 2 to 4 mm, especially preferably around 3 mm. The profile elements 144 and 164 are likewise essentially circular in shape in the view of FIG. 1*b*. However, they have a slighter diameter than the profile elements 142 and 162 and their profile depth is likewise smaller than that of the profile elements 142 and 162. It amounts to around 1 to 2 mm, especially preferably around 1.25 mm. The profile elements 142 and 162 of each group have roughly the same spacing from each other. Likewise, the profile elements 144 and 164 of each group have roughly the same spacing from each other. They therefore enable the positioning of the same reinforcement struts and/or hinge flaps of hinges joining together successive structural elements in different locations.

The profile elements of a group of profile elements 140*a*, 140*b*, 160*a*, 160*b* are situated in a length range of less than 50 mm, especially around 40 mm, while the profile elements of different groups have a spacing of 200 mm or more from each other. As is especially clearly shown in FIG. 1*a*, the shell bottom 110 has a number of lengthwise beads 116 extending in the lengthwise direction or parallel to the side structures of the shell 100.

Figure 2:
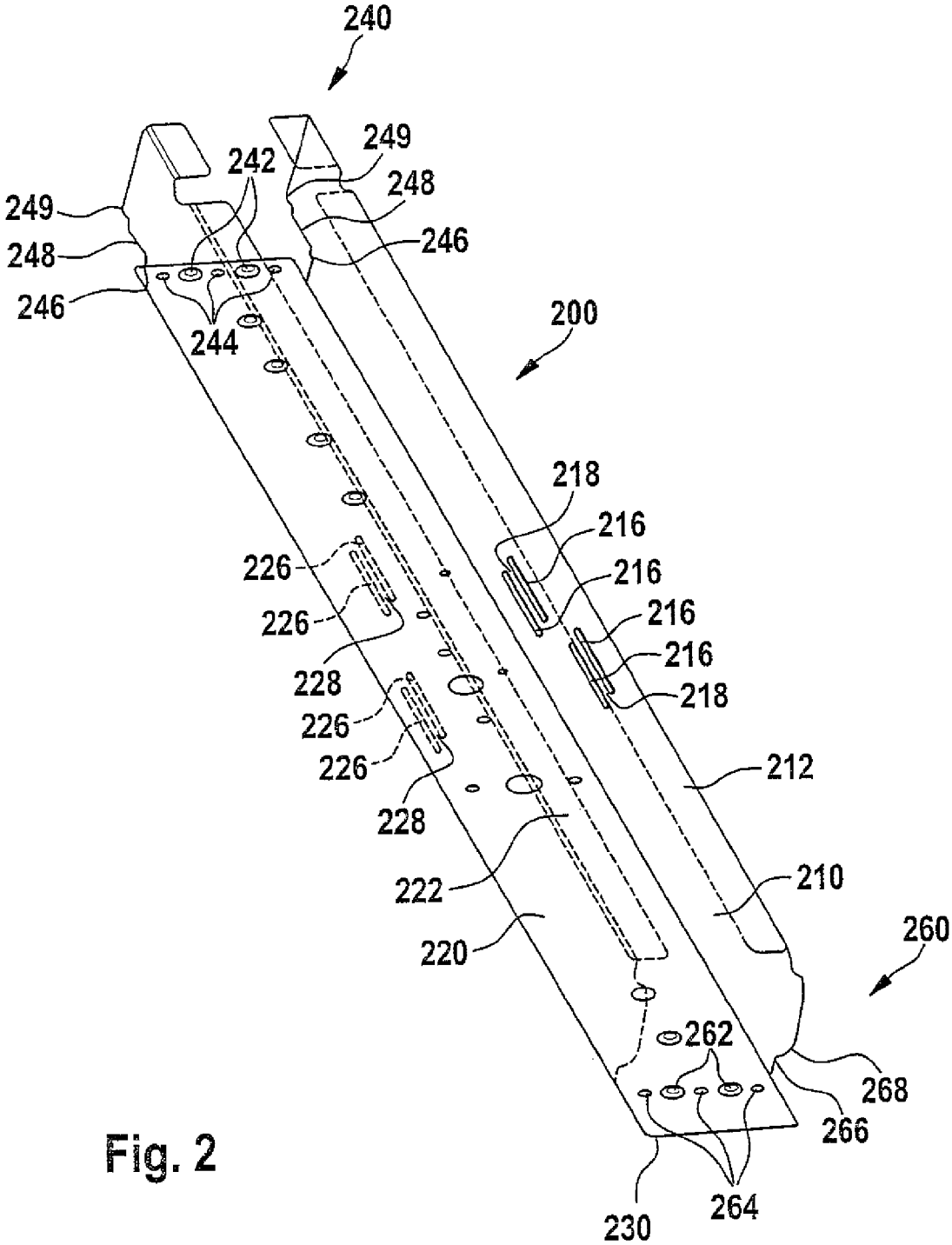

The reinforcement strut 200 shown in FIG. 2 is basically U-shaped with two outer legs 210 and 220 and a connection leg 230. The outer legs 210 and 220 pass at their edge away from the connection leg 230 into a fastening leg with fastening surfaces 212 and 222, running at a distance from the connection leg 230 roughly parallel with it. In the outer legs 210 and 220 there are formed slotlike recesses 216 and 226 running parallel to each other, between which is arranged a fixation area 218 or 228 which can bulge out from the main surface of the outer legs 210 and 220 for the fixation of an insulation element adjacent to the outer legs 210 and 220. A first axial end region 240 of the reinforcement strut 200 can be introduced into the side structure 130 of the shell 100 shown in FIG. 1*a* so that the corresponding axial end of the connection leg 230 conies to lie on the boundary surface of the fastening area. 160 facing away from the inner surface 114 of the shell bottom 110, while in the axial end region of the connection leg 230 an engaging structure is formed, complementary to the positioning aid, which consists of two dimples 242 with recesses made in them and three recesses 244, the recesses 242 and 244 being flush with the profilings 162 and 164 in the mounted state. Moreover, at the end face 240 of the reinforcement strut 200 there is situated a clamping area 246 in the edge of the outer leg 210 and 220, arranged at a distance from the connection leg 230, while the distance between the clamping area 246 and the edge of the connection leg 230 at the end face roughly corresponds to the width of the stabilization area 150 in a direction perpendicular to the shell bottom 110, so that the stabilization area 150 in the assembled state can be clamped between the clamping area 246 and the connection leg 230. The assembly is made easier in that the clamping area 246 passes into additional clamping areas 248 and 249 with greater distance from the connection leg 230.

The end face edge 260 of the reinforcement strut 200 that is opposite the end face edge 240 of the reinforcement strut 200 can be introduced into the side structure 120 of the shell 1000 that is provided with the indentation 122, whereupon one inner boundary surface of an end face edge of the connection leg 230 that is facing the fastening leg comes to lie on the boundary surface of the fastening area 140 that is away from the shell bottom 110, while in the end face edge region of the connection leg 230 there is configured an engaging structure that consists of recess-studded dimples 262 and recesses 264 that are flush with the dimples 142 and 144 of the fastening area 140 in the installed state. The end face edge 260 is also configured with a clamping area 266 arranged at a distance from the connection leg 230, so that the stabilization area 150 of the shell 100 in the mounted state can be clamped between the clamping area 266 and the end face edge of the connection leg 230. The installation is made easier by a ramp region 268 of the end face edge 260 of the reinforcement strut 200 that passes into the clamping area 266, so that the bending line 152 of the stabilization area 150 slides along the ramp region 268 during the installation process when the reinforcement strut 200, already shoved into the side structure 130, is swung about a pivot axis running parallel to the lengthwise direction of the side structure 130 toward the shell bottom 110, until the stabilization area 150 locks between the clamping area 266 and the connection leg 230.

It can be recognized that the reinforcement strut 200, in addition to the engaging structure formed by the dimples or perforations 262, 264, 242 and 244, also has further perforations. These additional perforations provide hole patterns for the placement of hinge flaps of different shape.

Figure 3:
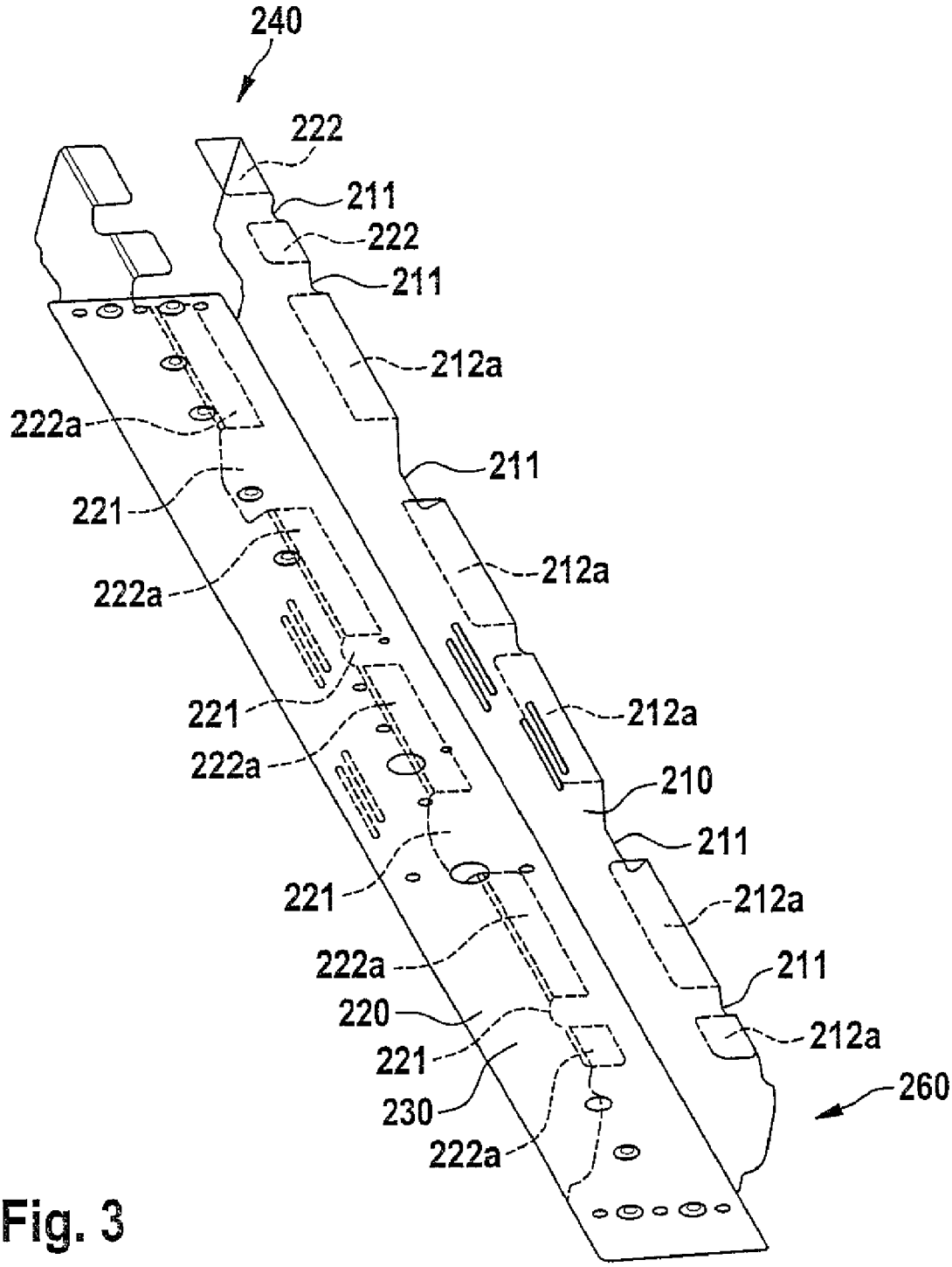
Figure 4:
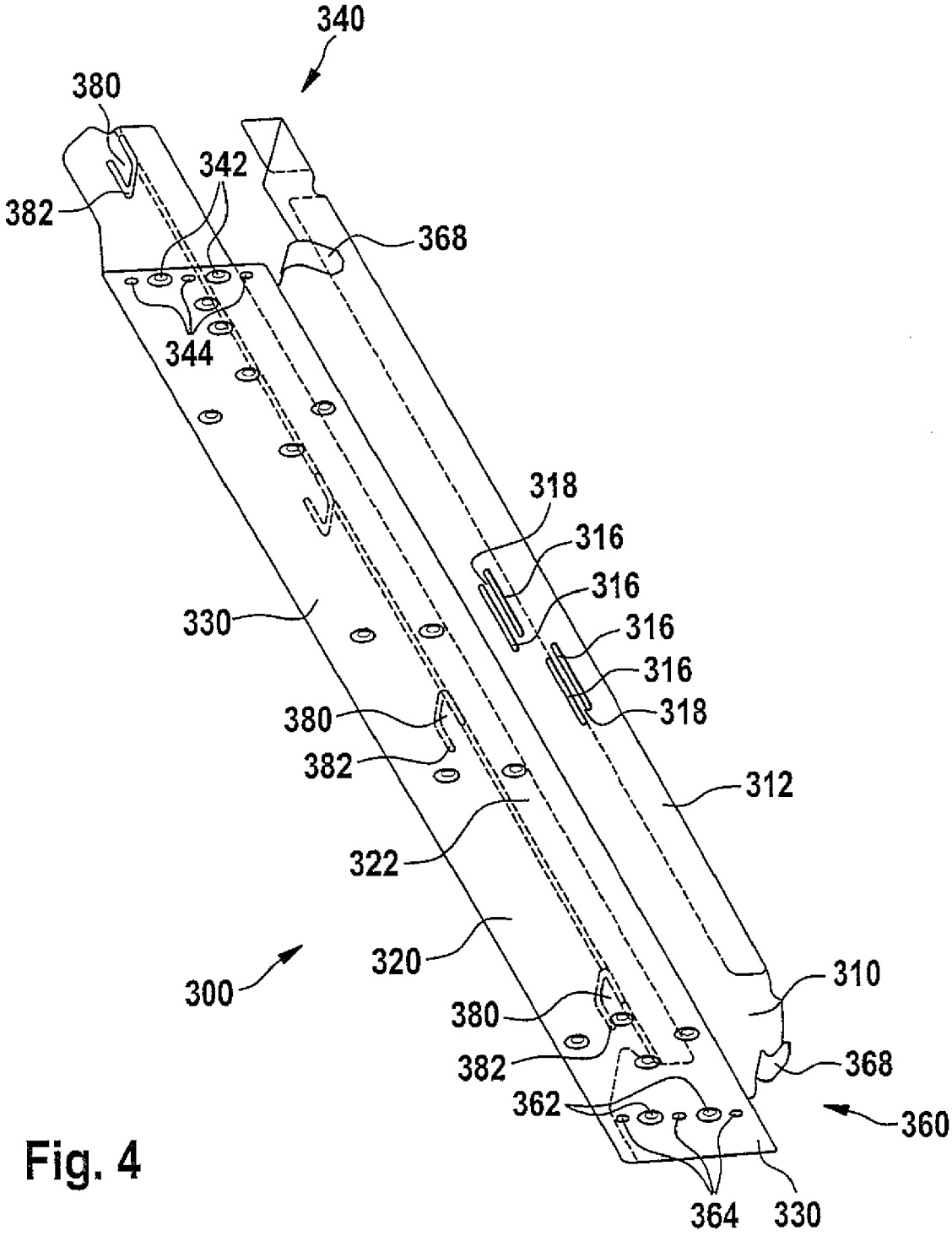

The embodiment presented in FIG. 3 of a reinforcement strut according to the invention differs basically from the embodiment discussed per FIG. 2 in that the outer legs 210 and 220 have indentations 211 and 221 on their edges facing away from the connection leg 230 for adapting to a surface structure of the inner surface 114 of the shell 100, for example, one formed by lengthwise beads 116. Thanks to the indentations 211 and 221, the fastening surfaces 212 and 222 or the corresponding fastening legs are divided into a number of fastening leg segments 212*a* and 222*a*. In the case of both embodiments of the invented reinforcement struts 200 discussed per FIGS. 2 and 3, the fastening surface 212, 222; 212*a*, 222*a* facing away from the connection leg is glued to the inner surface 114 of the shell 100. One can use a glue layer with a thickness of around 0.5 mm, in order to achieve a soundproofing, FIG. 4 shows a reinforcement strut configured as an end cap 300. The end cap 330 is also basically U-shaped with two outer legs 310, 320 and a connection leg 330. On the edges of the outer legs 310 and 320 facing away from the connection leg 330 there are formed inwardly bent fastening legs with fastening surfaces 312 and 322, which are staggered from each other in relation to an axis running perpendicular to the connection leg 330 by a distance roughly corresponding to the material thickness of the shell 100, so that the fastening area 322 is adjacent to the outer surface of the shell 100, while the fastening area 312 is adjacent to the inner surface of the shell 100, when the end cap 300 is shoved onto the shell 100 so that it spans the edge of the shell with the fastening area 322, the outer leg 320 and the connection leg 330, while an end face edge region 340 of the end cap 300 engages with the projection 132 of the shell, and an end face edge 360 of the end cap 300 engages with the side structure 130 of the shell 100, while [they] line up by recesses 364 or recess-studded dimples 342 on the one hand and recesses 364 or recess-studded dimples 362 on the other hand with the profilings 162, 164 and 142, 144 to ensure the desired positioning of the end cap 300 and provide positioning aids for screws that are inserted through the recesses 362, 364, 342 and/or 344 for the fastening of hinge flaps.

The outer leg 310 has fixation areas 318 and 328, bounded by slotlike recesses 316, for the fixation of an insulator or soundproofing element adjacent to the outer leg 310. The outer leg 320 has clamping tongues 380 bounded by U-shaped slots 382, which can be bent back in relation to a bending line 372 defined by the ends of the slotlike recess 382 toward the interior of the end cap 300. The bending line 372 runs at an acute angle to a normal to the surface on the fastening surface 322 and on the connection leg 330, so that the edge of the shell 100 lying against the fastening surface 322 in the mounted state is pressed in the direction of the fastening area 322.

In the area of the end face edges 340 and 360, the outer leg 310 is provided with guide areas in the form of tongues 368 folded back on themselves. The edges of the tongues 368 facing the connection leg 330 have a distance from the boundary surface of the connection leg 330 facing the fastening areas 312 and 322 corresponding to the height of the stabilization area 150 or 170 of the shell 100, so that the stabilization areas 150 and 170 in the installed state are clamped between the clamping tongues 380 and the end face edges of the connection leg 330. During the installation process, the edge of the shell 100 is introduced between the fastening surface 322 and the connection leg 330 such that the fastening surface 312 facing away from the connection leg 330 is at first arranged with a spacing above the inner surface 114 of the shell 100, so that a layer of adhesive applied to the boundary surface of the fastening area 312 that is facing away from the connection leg 330 at first does not bear against the inner surface 114. Once the edge of the shell 100 comes to bear against the outer leg 320, the end cap 300 is swiveled about a pivot axis running parallel to its lengthwise axis in the direction of the inner surface 114 of the shell 100, so that the boundary surface of the fastening area 312 facing away from the connection leg 330 comes to bear against the inner surface 114 and a material connection is produced, while at the same time an edge of the tongues 368 facing the connection leg 330 comes to bear against the bending lines 152 and 172 of the stabilization areas 150 and 170, so that the stabilization areas 150 and 170 are clamped between the tongues 368 and the end face edges of the connection leg 330. When shoving the end cap 300 onto the edge of the shell 100, the bending line 152 or 172 of the tongue 368 serves as a guide area, which slides along the stabilization areas 150 or 170. The connection leg 330 of the end cap 300 also has a number of additional perforations to enable the placement of hinge flaps with different hole patterns.

As can be seen in FIG. 4, in order to fabricate a complete structural element one needs two mirror-image end caps 300, if the side structures of the shell 100 have different configuration and/or an adaptation of the shape of the end caps 300 to the contour of the shell edges is desired. If such an adaptation is not desired and both outer legs 310, 320 of the end cap 300 are configured both with fixation areas 318, 328 and with clamping tongues 380, the same structural parts can be used for both sides of the shell 100.

Figure 5:
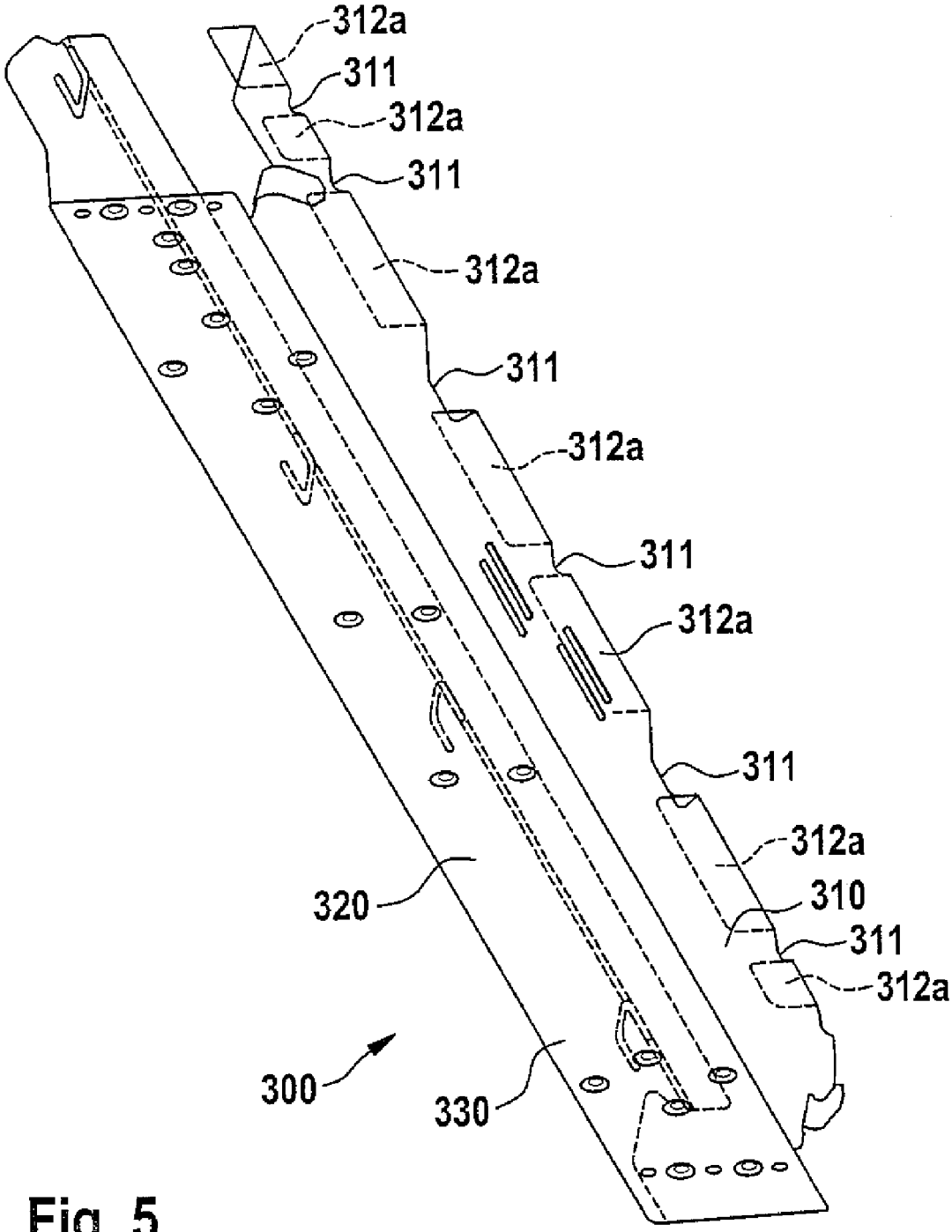

The embodiment of the invention shown in FIG. 5 differs from the embodiment discussed per FIG. 4 essentially only in that the edge of the outer leg 310 facing away from the connection leg 330 has a number of indentations 311 for adapting to a profiling of the inner surface 114 or the bottom 110 of the shell 100, which divide the fastening surface 312 into a plurality of segments 312*a*, each of which bear against the inner surface 114 of the shell bottom 110.

Figure 6D:
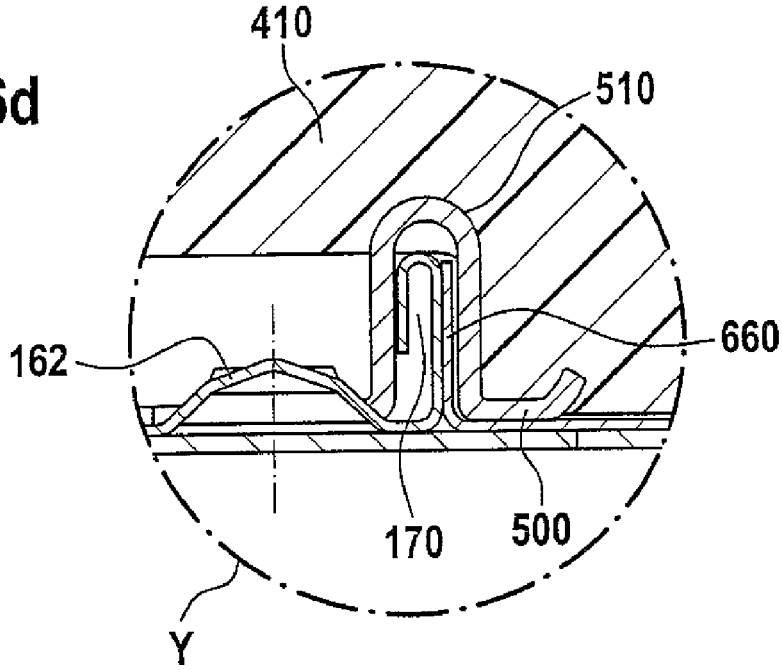
Figure 6E:
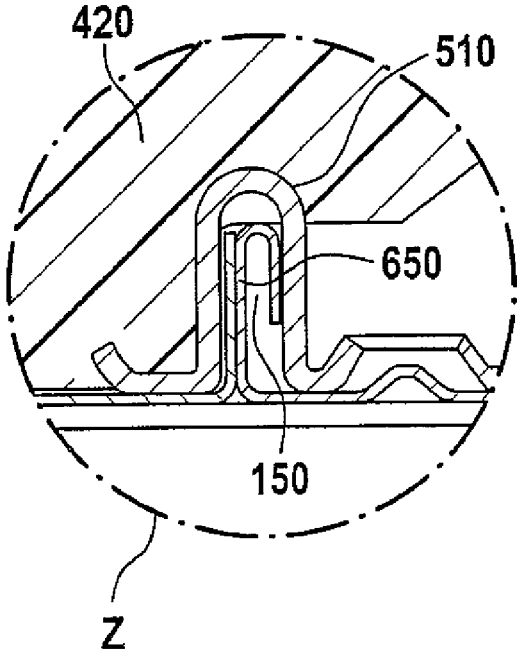

FIG. 6*a* shows a sectional view of a sample embodiment of the invention in sandwich design. In the sample embodiment shown in FIG. 6*a*, an insulation arrangement formed from two insulator elements 410 and 420 is inserted in the shell 100 of the structural element. As is especially clearly shown in FIGS. 6*b* and 6*c*, the edges of the insulator elements 410 and 420 running parallel to the side structures 120 and 130 of the shell 100 engage with the side structures 120 and 130 of the shell 100, gripping the stabilization areas 150 and 170 from underneath.

The structural element shown in FIGS. 6*a* to 6*e* has, in addition to the shell 100, the end cap 300 and the insulator elements 410 and 420, also reinforcement elements 500 that are arranged in the area of the edges of the insulator elements 410 and 420 running parallel to the side structures 120 and 130 between the insulator elements 410 and 420 on the one hand and the shell 100 or the side structures 120 and 130 of the shell 100 on the other hand, as is shown especially clearly in FIGS. 6*b* to 6*e*. Moreover, the structural element also has a cover device for covering the boundary surface of the insulator elements 410 and 420 facing away from the inner surface 114 of the shell 100. The cover device comprises a cover area running parallel to the inner surface 114 and two edges 650 and 660 running parallel to the stabilization areas 150 and 170 of the shell 100, As shown especially clearly in FIGS. 6*d* and 6*e*, the edges 650 and 660 as well as the stabilization areas 150 and 170 are received in grooves 510 of the reinforcement elements 500, in order to accomplish a fixation of the cover device on the shell 100. Moreover, one can see in FIGS. 6*d* and 6*e* that the reinforcement elements 500 are provided with recesses, which engage with the profile elements 142, 144, 162 and 164 of the shell 100. The reinforcement elements 500 also have additional perforations to enable the placement of hinge flaps with different hole patterns.

Figure 7A:
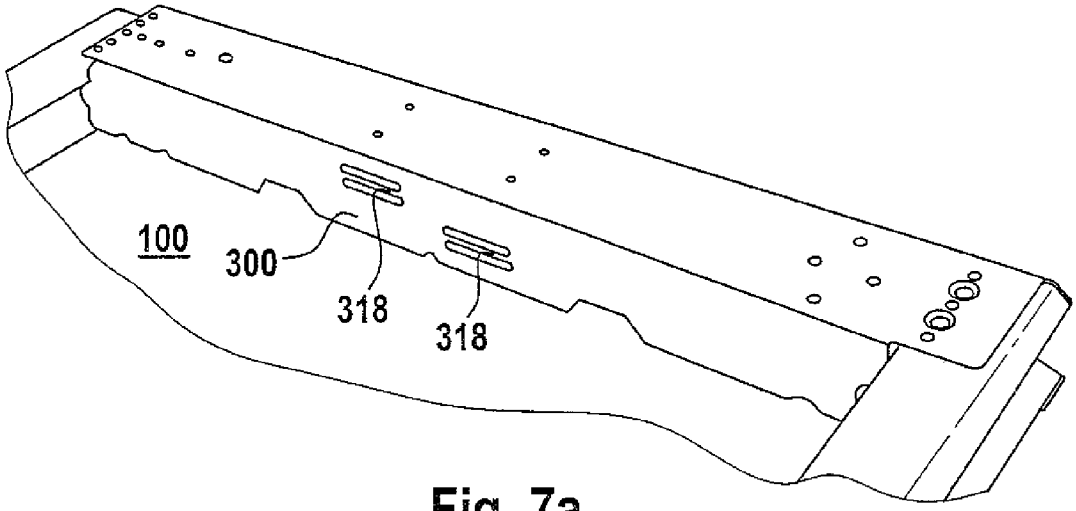

FIG. 7*a* shows a perspective view of an end cap 300 mounted on a shell 100.

Figure 7B:
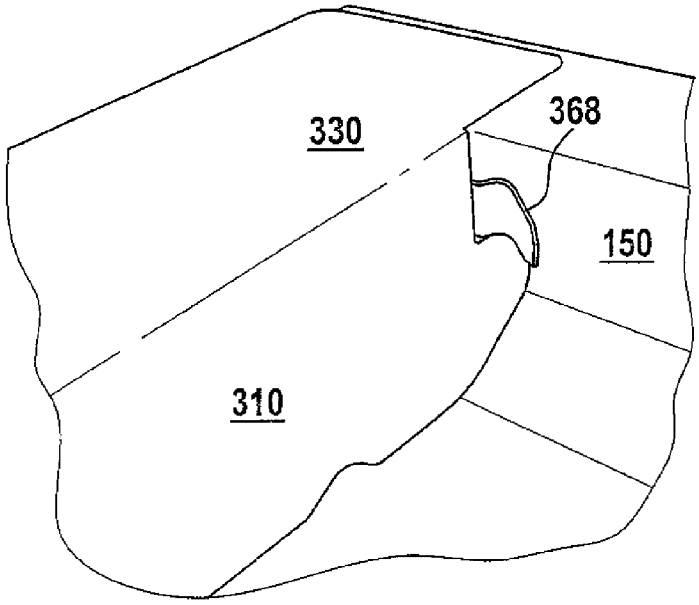

One notices in FIG. 7*b* how the tongues 368 folded back on themselves grip the stabilization area 150 from underneath, so that the stabilization area 150 is clamped between a boundary surface of the connection leg 330 facing toward the fastening area 140 and an end face edge of the connection leg 330.

Figure 7C:
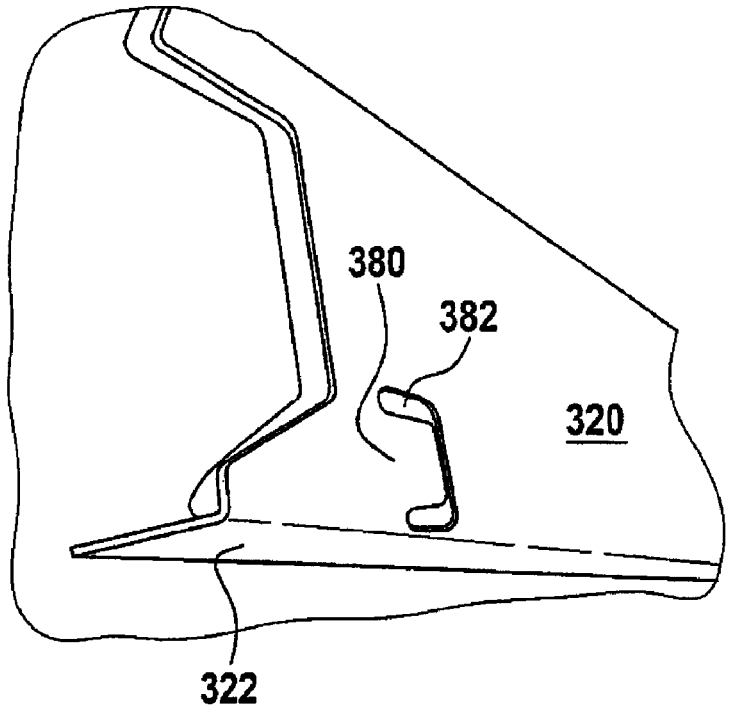
Figure 7D:
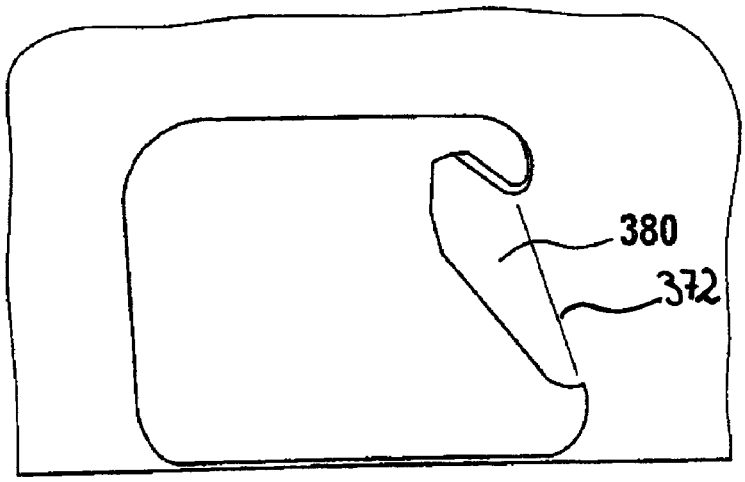

In FIG. 7*c*, one notices the clamping tongues 380 bounded by the U-shaped slot 382, which can be pushed into the end cap 300 for pressing the shell 100 against the outer fastening area 322, as shown in FIG. 7*d*, while the bending line 372 makes an acute angle with a normal to the surface on the outer fastening surface 322.

Figure 7E:
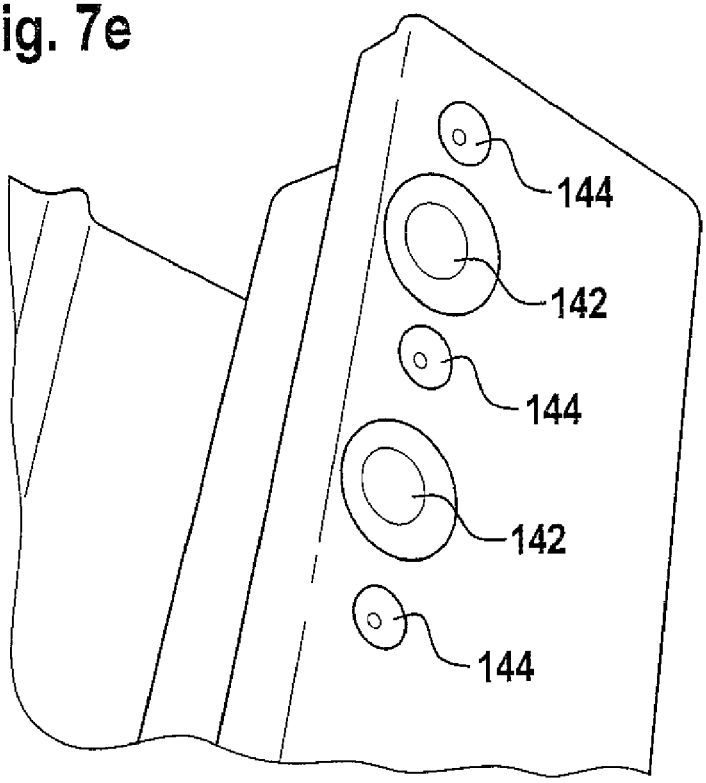

FIG. 7*e* shows in detail a profile element group, consisting of two profile elements 142 of larger diameter and greater profile depth and three profile elements 144 of smaller diameter and less profile depth.

Figure 7F:
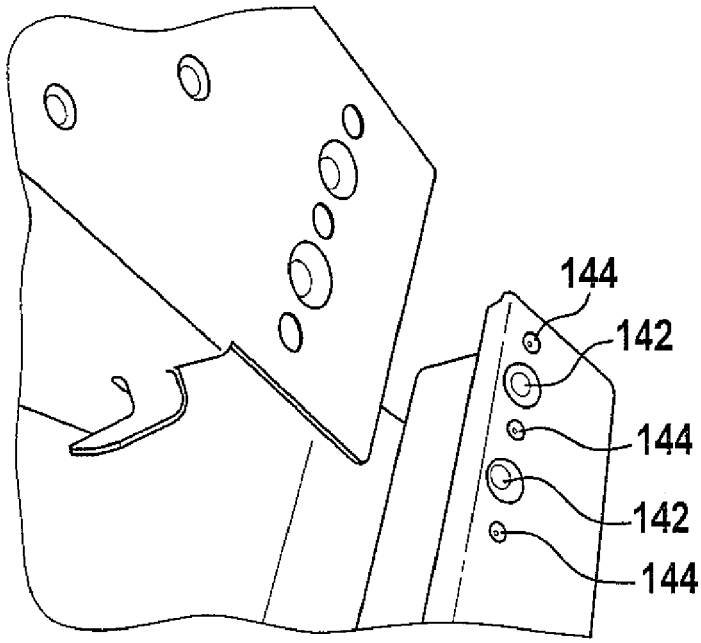

FIG. 7*f* shows that the distances of individual recesses 364 or recess-studded dimples 362 at the end face edge of the connection leg 330 of the end cap 300 are adapted to the distances between the profile elements 142 and 144 of the profile group at the fastening area 140 of the shell 100.

Figure 7G:
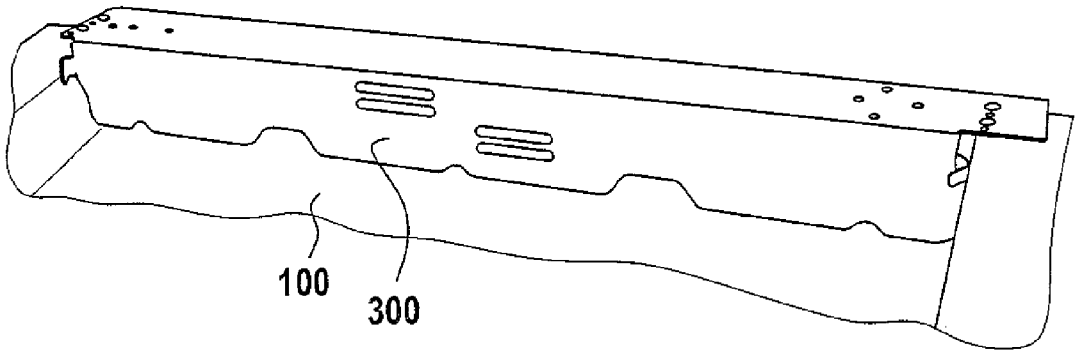
Figure 7H:
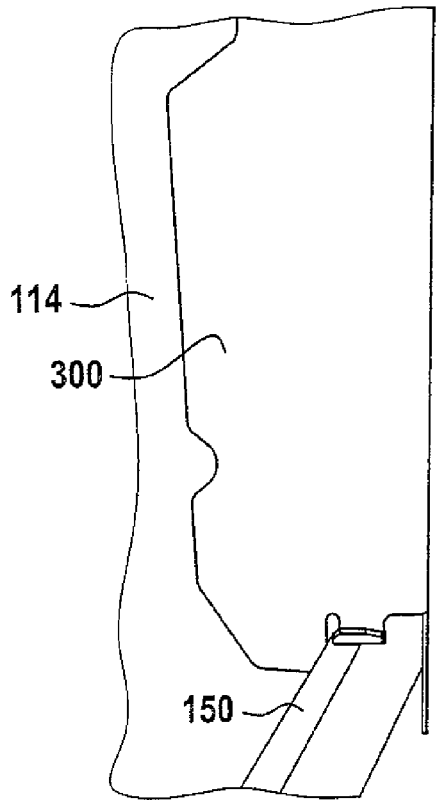

FIGS. 7*g* and 7*h* show the mounting of the end cap 300 on the shell 100. The end cap 300 is tilted and shoved onto the shell 100 so that the fastening area 322 on the inside is led at a distance above the inner surface 114 of the shell 100, while the end cap 300 is led by means of the tongues 368 along the stabilization area 150. Once the edge of the shell 100 comes to bear against the outer leg 320 of the end cap 300, the end cap 300 is swiveled about an axis running parallel to its lengthwise axis, so that the fastening area 322 comes to bear against the inner surface 114 of the shell 100.

Figure 8A:
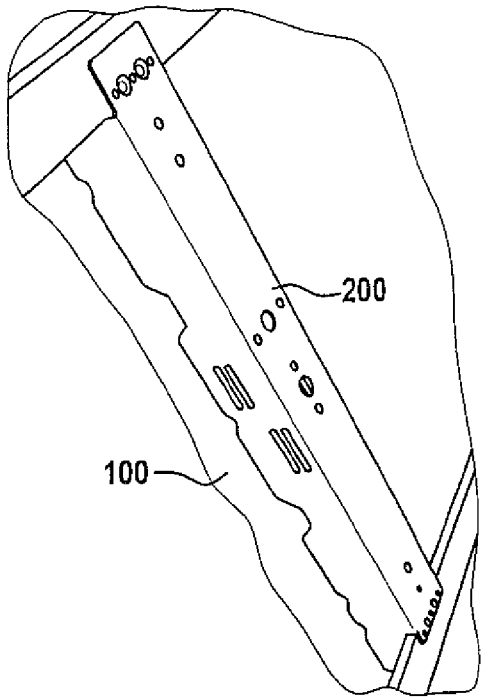

FIG. 8*a* shows a central reinforcement strut 200 mounted on a shell 100.

Figure 8B:
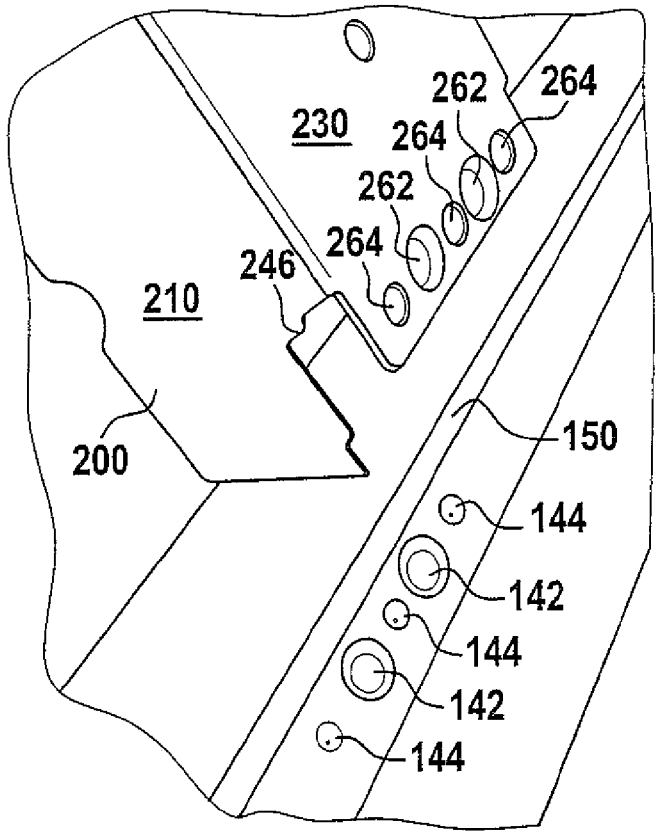

As can be seen from FIG. 8*b*, recesses 264 and recess-studded dimples 262 provided at the end face edge of the connection leg 230 of the reinforcement strut 200 are adapted in terms of their shape and arrangement to the shape and arrangement of individual (profile elements 162 and 164 of the fastening area 140 of the shell 100. One edge of the outer leg 210 of the reinforcement strut 200 facing toward the connection leg 230 has multiple steps, so that a clamping area 266 whose distance from the connection leg 230 corresponds roughly to the height of the stabilization area 150 passes into a step arranged at greater distance from the connection leg 230 and this in turn passes into a step arranged at an even greater distance from it. In this way, the shoving of the reinforcement strut 200 beneath the stabilization area 150 is made easier.

Figure 8C:
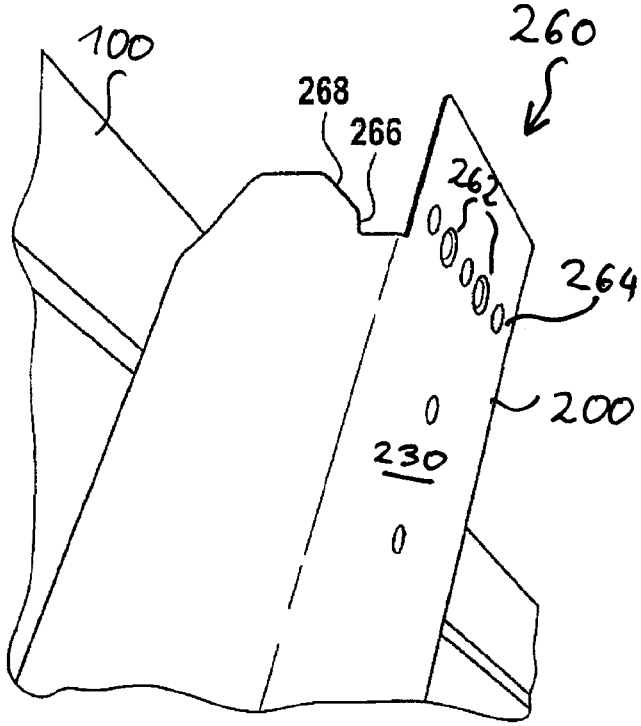
Figure 8D:
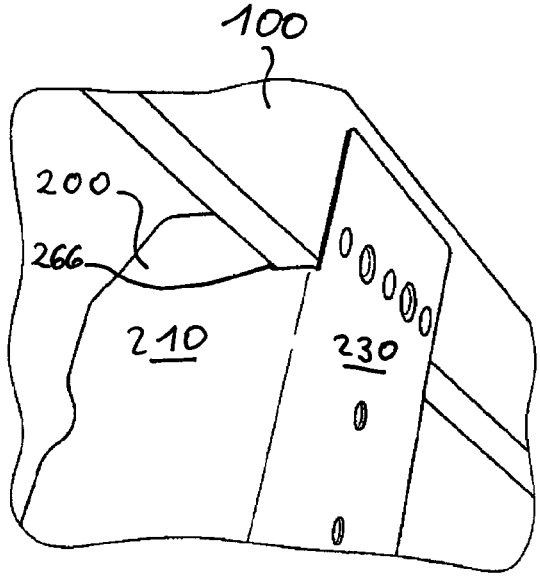

In the edge region 260 of the reinforcement strut 200, according to FIG. 8*c*, recesses 262 and recess-studded dimples 264 are likewise provided, whose shape and arrangement corresponds to the profile elements 162 and 164 of a profile area group in the fastening area 160 of the shell 100. At this edge, the clamping area 266 passes into a ramp 268, while an edge of the stabilization area 150 of the shell 100 that is formed by the bending line 152 slides along the ramp 268 during the mounting of the reinforcement strut 200, until it locks in between the clamping area 266 and the edge of the connection leg 230. This condition is shown in FIG. 8*d*.

Figure 9C:
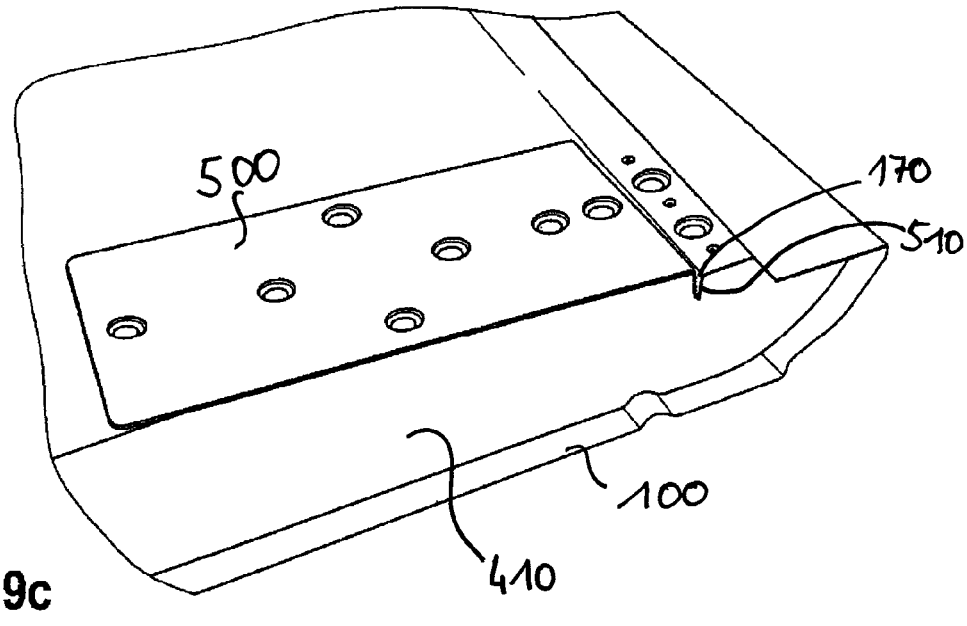
Figure 9D:
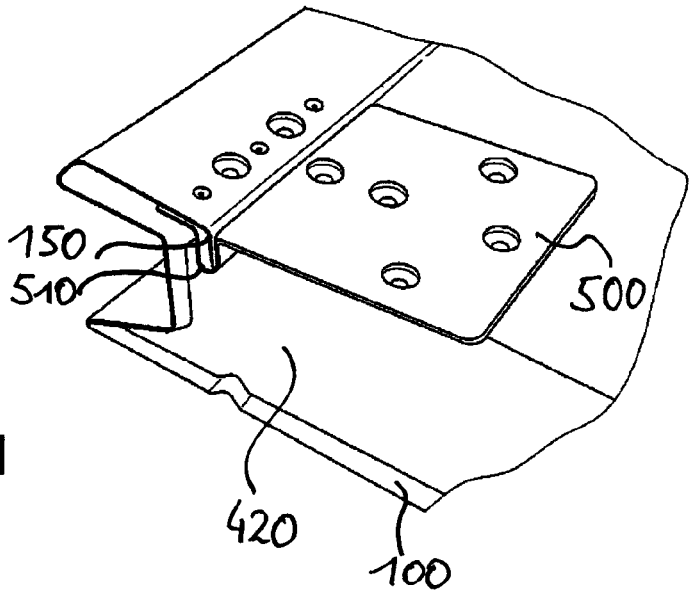
Figure 9E:
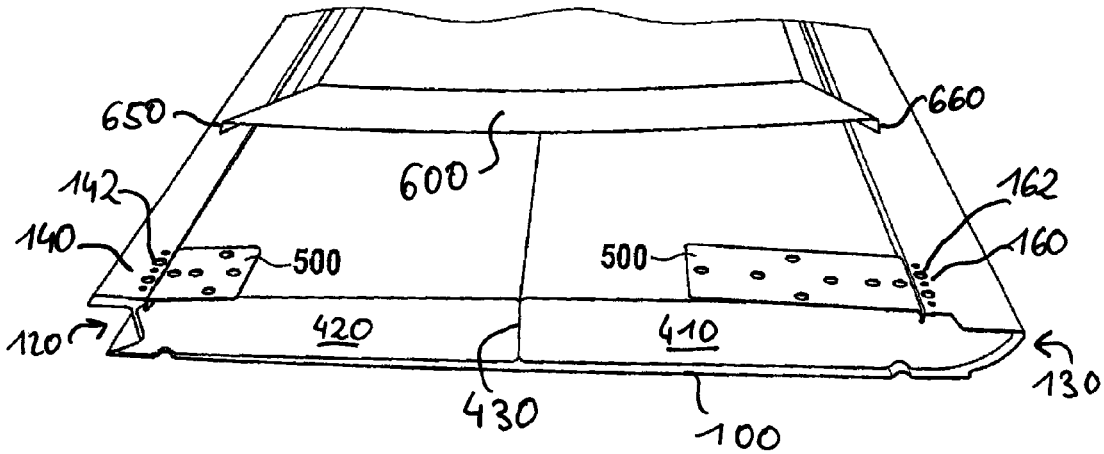
Figure 9F:
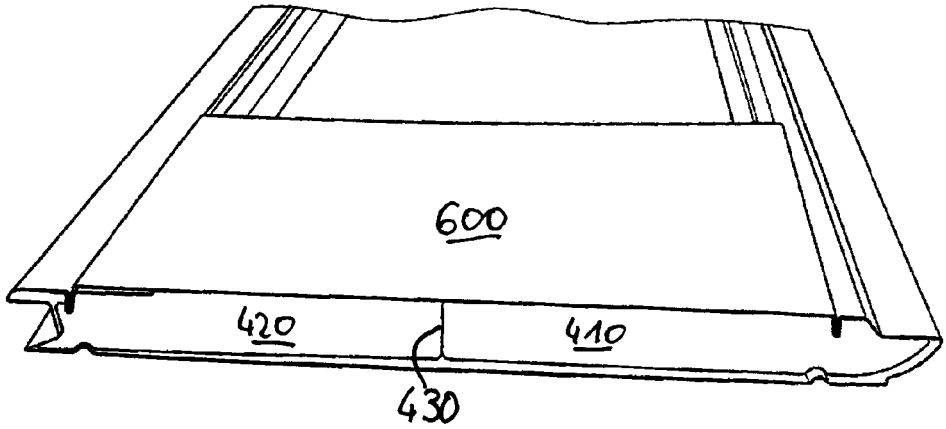
Figure 9G:
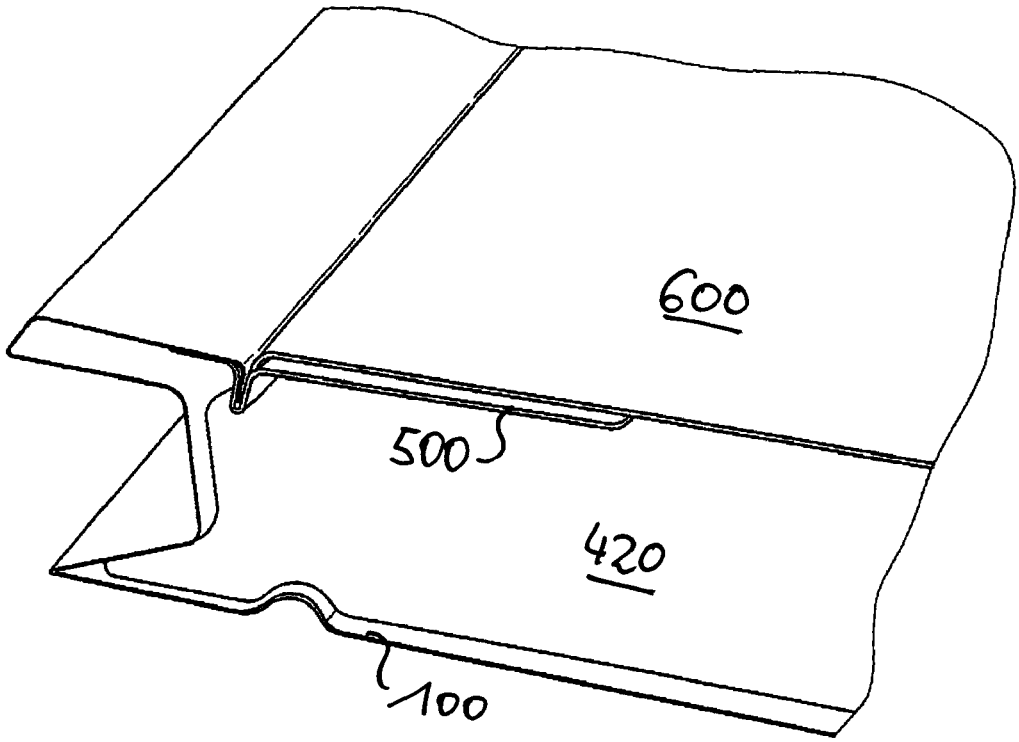
Figure 9H:
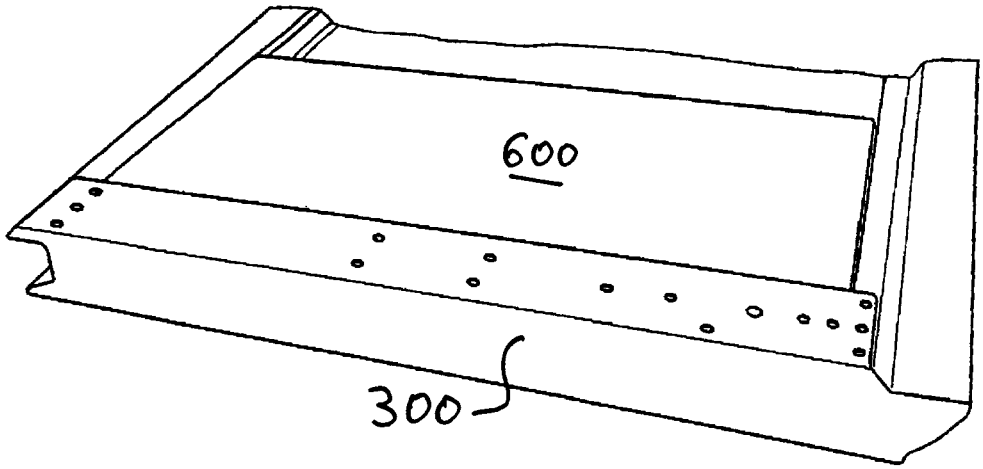
Figure 9I:
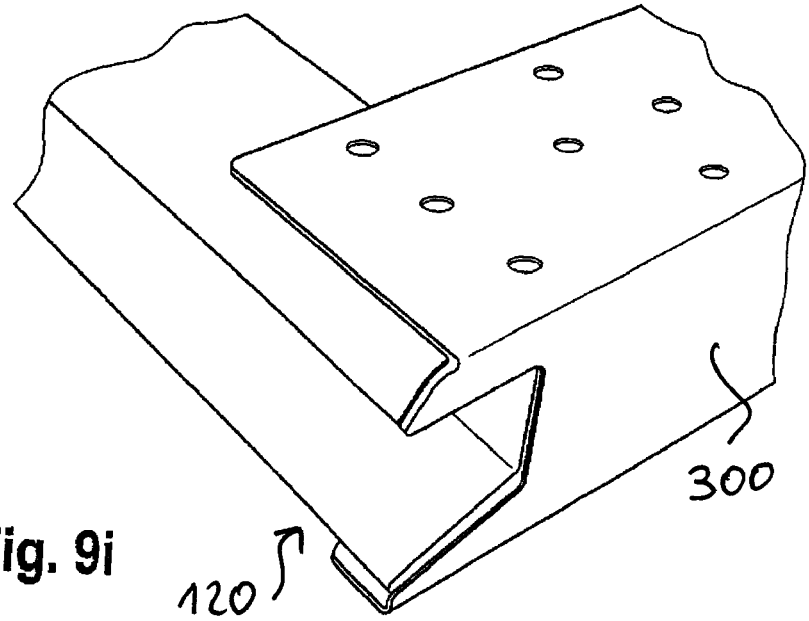
Figure 9J:
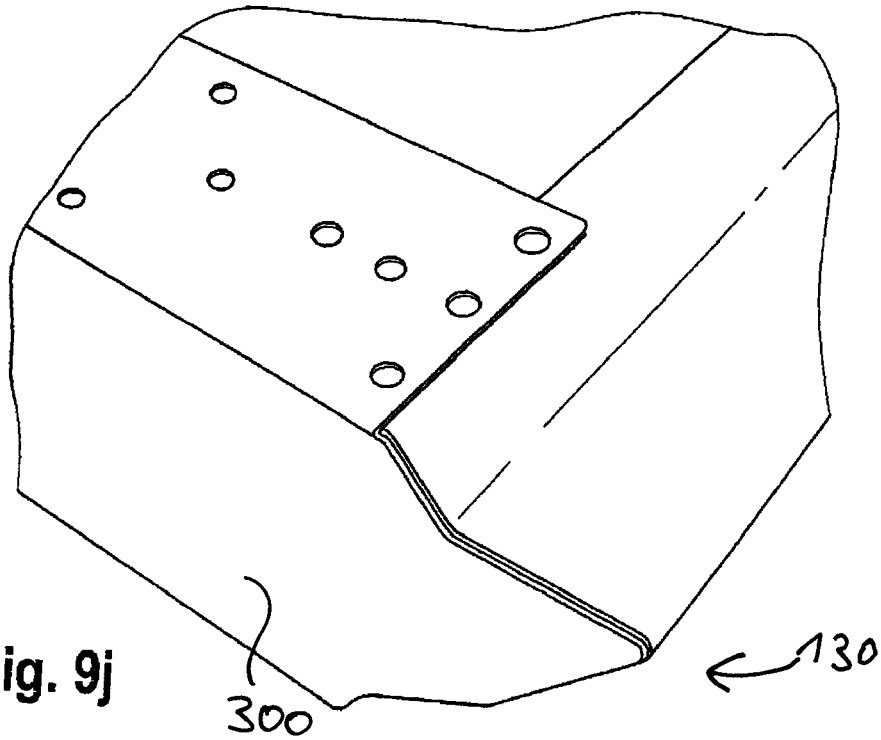

FIG. 9*a* shows individual parts used to make a structural element of sandwich design, namely, a shell 100, insulation elements 410, 420, reinforcement elements 500, and end cap 300 and a cover device 600. For the assembly of a structural element in sandwich design, at first the reinforcement elements 500 are placed by means of magnets on a boundary surface of the fastening area 140 facing toward the inner surface 114 of the shell 100, as shown in FIGS. 9*a* and 9*b*. Next, the insulation elements 410 and 420 are shoved between the reinforcement elements 500 and the inner surface 114 of the shell 100 into the side structures 120 and 130 of the shell, so that they are adjacent to each other along a separation surface 430 running centrally and perpendicular to the inner surface 114. This state is shown in FIGS. 9*c* to 9*e*. In this state, the stabilization areas 150 and 170 are received in corresponding grooves 510 of the reinforcement elements 500. Next, the cover device is placed on the boundary surface of the insulation elements 410 and 420 facing away from the inner surface 114 so that the edges 650 and 660 of the cover device likewise come to lie in the grooves 510 of the reinforcement elements 500, so that the cover device is secured by form-fitting to the side structures 120 and 130 of the shell 100. Finally, the end caps 300 are shoved onto the edges of the shell 100, the insulation elements 410 and 420, and the cover device, so that the holes in the edge area of the end caps 300 are flush with profile elements 162 and 164 of a profile group at the end face edge of the fastening areas 140 and 160 of the shells 100, as shown in FIGS. 9*h* to 9*j*.

The invention is not limited to the sample embodiments discussed by means of the drawing. One can also conceive of using other kinds of positioning aids, such as in the form of pins, raised profilings, and the like. Also, the reinforcement struts can have different shapes and/or be fastened otherwise to the shell. Moreover, various kinds of sandwich design are possible.

The invention claimed is:

1. Structural element for making a door leaf of a sectional door, which is movable along a predetermined path between a closed and an open setting, with a shell having two edge portions that run essentially perpendicular to the predetermined path and parallel to each other and that are folded back on themselves to form predetermined side structures, the shell having an outer surface that constitutes an exterior surface of the door leaf facing away from an interior space to be closed off in a closed setting and an inner surface opposite to the outer surface, wherein at least one side structure of the shell has a fastening area provided for attachment of at least one hinge for connecting structural elements arranged successively in a moving direction of the door leaf, wherein the fastening area of the shell has at least one positioning aid configured as a profiling extending perpendicular to the outer surface for a reinforcement strut, wherein the structural element further includes said reinforcement strut configured as an end cap spanning an edge at an end face of the shell, wherein said end cap extends roughly perpendicular to the side structures and has an engaging structure lying against a boundary surface of the fastening area and configured complementary to the profiling of the positioning aid, wherein the end cap has an outer leg with an outer fastening surface adjacent to the outer surface and an inner fastening surface at a distance from the outer fastening surface in a lengthwise direction of the at least one side structure and adjacent to the inner surface of the shell, and wherein the outer leg has a clamping tongue bounded by a slot and able to be bent into an interior of the end cap for pressing the outer surface of the shell against the outer fastening surface.

2. Structural element according to claim 1, wherein the shell is a metal shell.

3. Structural element according to claim 1, wherein the positioning aid is a circular dimple.

4. Structural element according to claim 1, wherein the slot is U-shaped.

5. Structural element according to claim 1, wherein a layer of adhesive is applied to the inner fastening surface in order to produce a material connection between the inner fastening surface and the inner surface of the shell.

6. Structural element according to claim 1, wherein the positioning aid has at least one group of two, three or more profile elements situated alongside each other in the lengthwise dimension of the side structure, wherein the profile elements are coordinated with a group, a hinge or a reinforcement strut.

7. Structural element according to claim 1, wherein at least two profile elements of a group have roughly the same configuration in a cross sectional plane perpendicular to the lengthwise direction of the side structure.

8. Structural element according to claim 6, wherein at least two profile elements of a group have different profile depths or diameters in a cross sectional plane perpendicular to the lengthwise direction of the side structure.

9. Structural element according to claim 6, wherein the profile elements of one group are arranged in the lengthwise direction of the side structure within a length range of 80 mm or less.

10. Structural element according to claim 6, wherein at least one side structure has two, three or more groups of profile elements situated alongside each other in the lengthwise direction of the side structure, wherein individual profile elements of groups situated alongside each other are situated at a distance of 200 mm or more from each other.

11. Structural element according to claim 6, wherein profile elements of identical cross sectional form within different groups have same spacings in the lengthwise direction of the side structure from each other.

12. Structural element according to claim 1, wherein the fastening area passes at the edge into a stabilization area, roughly perpendicular to the outer surface, extending parallel to the side structure and starting from the fastening area moving toward the inner surface, the stabilization area being folded back on itself relative to a bending line running parallel to the lengthwise direction of the side structure, wherein the bending line runs at a distance of 15 mm or more from the inner surface of the shell.

13. Structural element according to claim 1, wherein the engaging structure has at least one recess at least partly occupied by a profile element in an installed state or a profile element at least partly contained in at least one profile element of the fastening area.

14. Structural element according to claim 1, wherein the reinforcement strut has at least one fastening area adjoining the inner or outer surface of the shell that is joined by a material connection to the inner and outer surface.

15. Structural element according to claim 1, wherein the reinforcement strut is U-shaped, with two outer legs and a connection leg joining the outer legs to each other, wherein the engaging structure is made on and at least one fastening surface is made on an edge area of an outer leg facing away from the connection leg and extending roughly parallel to the connection leg.

16. Structural element according to claim 15, wherein a fastening area is formed on each outer leg, wherein the at least one fastening surface is bent to protrude into the inner space of the reinforcement strut formed between the outer legs.

17. Structural element according to claim 1, wherein the reinforcement strut has a fixation area formed between two parallel running slot-like recesses in at least one outer leg for the fixation of an insulation element lying against the inner surface of the shell and the outer leg.

18. Structural element according to claim 2, wherein at least one end face of the reinforcement strut has a clamping area, whose distance from the connection leg in a direction running perpendicular to the connection leg roughly corresponds to a width of the stabilization area in this direction, wherein the stabilization area is arranged between the clamping area and the connection leg.

19. Structural element according to claim 18, wherein at least one clamping area of the reinforcement strut is coordinated with a guide area, along which the stabilization area is guided along the inner surface of the shell when installing the reinforcement strut before it locks between the connection leg and the clamping area.

20. Structural element according to claim 19, wherein the guide area has a ramp area rising up from an edge region lying between the edge of the outer leg facing away from the connection leg and the clamping area in the direction of the clamping area.

21. Structural element according to claim 19, wherein the guide area has at least one tongue bent outward from one outer leg and bent back on itself in the direction of the outer leg.

22. Structural element according to claim 4, wherein a connection line between ends of the U-shaped slot makes an acute angle with a normal to a surface on the outer fastening surface or the outer surface of the shell.

23. Structural element according to claim 1, further comprising an insulator arrangement adjacent to the inner surface of the shell, the insulator arrangement engaging at least partly with at least one side structure, and being made of Styrofoam or polyurethane (PU).

24. Structural element according to claim 23, wherein the insulator arrangement has at least two insulating elements separated from each other along a plane of separation running parallel to the side structures.

25. Structural element according to claim 24, wherein at least one insulator element has an edge region reaching under a stabilization area and accommodated at least partly in a side structure.

26. Structural element according to claim 23, further comprising a cover device covering a boundary surface of the insulator arrangement facing away from the inner surface of the outer shell.

27. Structural element according to claim 26, wherein the cover device has a cover area running roughly parallel to the inner surface of the outer shell and at least one edge area running parallel to a stabilization area of the shell and adjacent to the stabilization area.

28. Structural element according to claim 1, further comprising a reinforcement arrangement adjacent to the boundary surface of the fastening area, facing the inner surface of the shell and held by the positioning aid in a predetermined position relative to the fastening area.

29. Structural element according to claim 28, wherein the reinforcement arrangement has two, three or more reinforcement elements arranged alongside each other with a spacing in the lengthwise direction of the at least one side structure, wherein each of the reinforcement elements is coordinated with a group of profile elements.

30. Structural element according to claim 29, wherein at least one reinforcement element has two, three or more recesses to receive screws serving for the fastening of hinge flaps, of which at least one receives, at least partly, a profile element of the positioning arrangement.

31. Structural element according to claim 28, wherein the reinforcement arrangement has a groove accommodating a stabilization area of the shell and an edge area of a cover device.

32. Structural element according to claim 1, wherein a ratio of a length of the shell in the lengthwise direction of the at least one side structure to a height of the shell in the moving direction of the door leaf is 15 or less.

33. Structural element according to claim 1, wherein the structural element is part of a sectional door leaf.

34. Structural element according to claim 33, wherein the sectional door leaf is configured to interact with a guide rail arrangement with two parallel guide rails, each of which comprises a first straight segment to accommodate the sectional door leaf in a closed setting, a second straight segment to accommodate the sectional door leaf in an open setting, and an arc-shaped segment that joins the straight segments to each other.

35. Structural element according to claim 9, wherein the profile elements of one group are arranged in the lengthwise direction of the side structure within a length range of 40 mm.

36. Structural element according to claim 10, wherein individual profile elements of groups situated alongside each other are situated at a distance of 600 mm or more from each other.

37. Structural element according to claim 12, wherein the bending line runs at a distance of 25 mm or more from the inner surface of the shell.

38. Structural element according to claim 13, wherein the engaging structure is in the form of a dimple with the at least one recess passing through the dimple.

39. Structural element according to claim 14, wherein the at least one fastening area is joined by glue to the inner and outer surface.

40. Structural element according to claim 32, wherein the ratio is 10 or less.

* * * * *